US008050597B2

(12) United States Patent
Yoshizawa et al.

(10) Patent No.: US 8,050,597 B2
(45) Date of Patent: Nov. 1, 2011

(54) TONER CONTAINER HAVING A GEAR PORTION AND IMAGE FORMING APPARATUS

(75) Inventors: Hideo Yoshizawa, Kanagawa (JP); Tadashi Hayakawa, Kanagawa (JP); Masashi Hasegawa, Shizuoka (JP); Makoto Kawaguchi, Shizuoka (JP)

(73) Assignee: Ricoh Company, Limited, Tokyo (JP)

( * ) Notice: Subject to any disclaimer, the term of this patent is extended or adjusted under 35 U.S.C. 154(b) by 791 days.

(21) Appl. No.: 11/933,766

(22) Filed: Nov. 1, 2007

(65) Prior Publication Data

US 2008/0124133 A1 May 29, 2008

(30) Foreign Application Priority Data

| | | |
|---|---|---|
| Nov. 9, 2006 | (JP) | 2006-304535 |
| Jan. 12, 2007 | (JP) | 2007-003991 |
| May 28, 2007 | (JP) | 2007-140412 |
| May 30, 2007 | (JP) | 2007-142814 |
| Jun. 14, 2007 | (JP) | 2007-156942 |

(51) Int. Cl.
*G03G 15/08* (2006.01)

(52) U.S. Cl. ..... 399/262; 399/261; 399/258

(58) Field of Classification Search ..... 399/262, 399/258

See application file for complete search history.

(56) References Cited

U.S. PATENT DOCUMENTS

| | | | | |
|---|---|---|---|---|
| 4,611,899 A | | 9/1986 | Kasamura et al. | |
| 5,184,181 A | | 2/1993 | Kurando et al. | |
| 5,402,207 A | * | 3/1995 | Michlin | 399/117 |
| 5,441,177 A | | 8/1995 | Yanagisawa | |
| 5,495,323 A | * | 2/1996 | Meetze, Jr. | 399/120 |
| 5,515,143 A | | 5/1996 | Shiotani | |
| 5,520,229 A | | 5/1996 | Yamada | |
| 5,530,531 A | | 6/1996 | Girard | |
| 5,648,840 A | | 7/1997 | Ikunami et al. | |
| 5,722,014 A | | 2/1998 | Fike | |
| 5,765,079 A | | 6/1998 | Yoshiki et al. | |
| 5,794,108 A | | 8/1998 | Yoshizawa et al. | |
| 5,867,757 A | | 2/1999 | Okazaki et al. | |
| 5,878,307 A | | 3/1999 | Greenlaw et al. | |
| 5,890,040 A | | 3/1999 | Matsuoka et al. | |
| 5,970,290 A | | 10/1999 | Yoshiki et al. | |
| 5,991,584 A | | 11/1999 | Meyer et al. | |
| 6,104,902 A | | 8/2000 | Meyer et al. | |

(Continued)

FOREIGN PATENT DOCUMENTS

EP 0 616 268 A1 9/1994

(Continued)

OTHER PUBLICATIONS

Taiwan Office Action No. 09920273500 dated Apr. 26, 2010 with English translation (8 pages).

(Continued)

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

A toner container includes a container body that contains toner therein, and a cap portion that is held by a toner-container holding unit and includes a toner discharge opening to discharge the toner contained in the container body. A gear portion is detachably attached to the container body so that a rotational force is transmitted to the container body.

19 Claims, 20 Drawing Sheets

U.S. PATENT DOCUMENTS

| | | | |
|---|---|---|---|
| 6,169,864 | B1 | 1/2001 | Baxendell et al. |
| 6,256,470 | B1 | 7/2001 | Taniyama et al. |
| 6,259,877 | B1 | 7/2001 | Taniyama et al. |
| 6,292,644 | B1 | 9/2001 | Goto et al. |
| 6,298,208 | B1 | 10/2001 | Kawamura et al. |
| 6,526,243 | B2 | 2/2003 | Kim et al. |
| 6,567,637 | B2 | 5/2003 | Yanagisawa et al. |
| 6,628,908 | B2 | 9/2003 | Matsumoto et al. |
| 6,665,508 | B2 | 12/2003 | Sudo et al. |
| 6,678,492 | B1 | 1/2004 | Terazawa et al. |
| 6,785,497 | B1 | 8/2004 | Hasebe |
| 6,795,673 | B2 | 9/2004 | Yoshizawa |
| 6,826,381 | B2 | 11/2004 | Muramatsu et al. |
| D500,076 | S | 12/2004 | Takuwa |
| 7,088,942 | B2 | 8/2006 | Minagawa |
| 7,110,705 | B2 | 9/2006 | Harumoto |
| 7,110,707 | B2 | 9/2006 | Nishitani |
| 7,116,928 | B2 | 10/2006 | Muramatsu et al. |
| D532,037 | S | 11/2006 | Tsuda et al. |
| 7,221,891 | B2 | 5/2007 | Matsumoto et al. |
| 7,245,852 | B2 | 7/2007 | Takuwa |
| 7,248,824 | B2 | 7/2007 | Takami |
| 7,313,349 | B2 | 12/2007 | Suzuki et al. |
| 7,321,744 | B2 | 1/2008 | Hosokawa et al. |
| 7,346,299 | B2 | 3/2008 | Muramatsu et al. |
| 7,450,891 | B2 | 11/2008 | Muramatsu et al. |
| 7,480,476 | B2 | 1/2009 | Hosokawa et al. |
| 7,536,139 | B2 | 5/2009 | Katsuyama et al. |
| 7,542,703 | B2 | 6/2009 | Kasahara et al. |
| 7,577,379 | B2 | 8/2009 | Kita et al. |
| D599,845 | S | 9/2009 | Kurenuma et al. |
| 7,590,374 | B2 | 9/2009 | Takami |
| 7,593,674 | B2 | 9/2009 | Matsumoto et al. |
| D602,985 | S | 10/2009 | Yoshizawa |
| 7,603,054 | B2 | 10/2009 | Katsuyama et al. |
| 2002/0034398 | A1 | 3/2002 | Higeta et al. |
| 2003/0198488 | A1 | 10/2003 | Wang et al. |
| 2003/0202823 | A1 | 10/2003 | Tamura |
| 2003/0219263 | A1 | 11/2003 | Tsuzuki |
| 2004/0184841 | A1 | 9/2004 | Tsuda et al. |
| 2004/0223790 | A1 | 11/2004 | Hosokawa et al. |
| 2004/0228641 | A1 | 11/2004 | Rommelmann et al. |
| 2004/0247344 | A1 | 12/2004 | Fujii et al. |
| 2005/0008400 | A1 | 1/2005 | Tazawa et al. |
| 2005/0041998 | A1 | 2/2005 | Fujii et al. |
| 2005/0196180 | A1 | 9/2005 | Harumoto |
| 2005/0254841 | A1 | 11/2005 | Tomitaka |
| 2006/0034642 | A1 | 2/2006 | Taguchi et al. |
| 2006/0210319 | A1 | 9/2006 | Katsuyama |
| 2007/0147902 | A1 | 6/2007 | Taguchi et al. |
| 2007/0154243 | A1 | 7/2007 | Taguchi et al. |
| 2007/0253745 | A1 | 11/2007 | Maruyama |
| 2007/0264055 | A1* | 11/2007 | Thornton et al. ..... 399/262 |
| 2008/0012961 | A1* | 1/2008 | Masubuchi ..... 348/231.7 |

FOREIGN PATENT DOCUMENTS

| | | |
|---|---|---|
| JP | 05-107918 | 4/1993 |
| JP | 6-149047 | 5/1994 |
| JP | 7-257625 | 10/1995 |
| JP | 2000-172060 | 6/2000 |
| JP | 2000-172061 | 6/2000 |
| JP | 2000-338758 | 12/2000 |
| JP | 2001-22249 | 1/2001 |
| JP | 2002-031943 | 1/2002 |
| JP | 2003-122099 | 4/2003 |
| JP | 2003-241497 | 8/2003 |
| JP | 2003-287946 | 10/2003 |
| JP | 2004-018138 | 1/2004 |
| JP | 2004-161371 | 6/2004 |
| JP | 2004-161373 | 6/2004 |
| JP | 2004-205797 | 7/2004 |
| JP | 2004-287404 | 10/2004 |
| JP | 2005-37675 | 2/2005 |
| JP | 2005-216263 | 8/2005 |
| JP | 2005-221825 | 8/2005 |
| JP | 2006-11134 | 1/2006 |

OTHER PUBLICATIONS

Taiwan Office Action No. 09920343030 dated May 21, 2010 with English translation (9 pages).

Japanese Office Action for JP 2009-245016 dated Apr. 30, 2010 with English translation (8 pages).

Japanese Office Action for Japanese Patent Application 2007-156942, dated May 17, 2011.

Japanese Office Action for Japanese Patent Application 2007-142814, dated May 23, 2011.

* cited by examiner

TONER CONTAINER HAVING A GEAR PORTION AND IMAGE FORMING APPARATUS

CROSS-REFERENCE TO RELATED APPLICATIONS

The present application claims priority to and incorporates by reference the entire contents of Japanese priority document, 2006-304535 filed in Japan on Nov. 9, 2006, Japanese priority document, 2007-003991 filed in Japan on Jan. 12, 2007, Japanese priority document, 2007-140412 filed in Japan on May 28, 2007, Japanese priority document, 2007-156942 filed in Japan on Jun. 14, 2007, and Japanese priority document, 2007-142814 filed in Japan on May 30, 2007.

BACKGROUND OF THE INVENTION

1. Field of the Invention

The present invention relates to a toner container and an image forming apparatus including the toner container.

2. Description of the Related Art

In a conventional image forming apparatus using the electrophotographic system, a cylindrical toner container for supplying toner to a developing unit is known (see, for example, Japanese Patent Application Laid-open No. 2004-287404).

In Japanese Patent Application Laid-open No. 2004-287404, a toner container (a toner bottle), which is attached to a toner-container holding unit (a bottle holder) of an image forming apparatus in a replaceable manner, includes a container body and a cap portion. A spiral-shaped protrusion is formed on an inner circumferential surface of the container body, and the toner contained in the container body is conveyed toward an opening thereof through rotation of the container body. The cap portion communicates with the opening, and is held by the toner-container holding unit in a nonrotatable manner, i.e., the cap portion does not rotate with the container body. The toner discharged from the opening is discharged from a toner discharge opening provided in the cap portion, and is then supplied to the developing unit. The container body is rotated by the rotational force transmitted to a gear portion that is integrally provided on the container body.

Such toner container can reduce toner stain upon replacement of the toner container as compared with a toner container that has no cap portion and directly supplies toner from the opening of the container body to the developing unit such as the one disclosed in Japanese Patent Application Laid-open No. 2000-338758. Specifically, because the toner discharge opening is opened/closed in synchronization with a part of an attachment/detachment operation (rotating operation) of the toner container, such a problem that a user's hand becomes stained with toner by touching the toner discharge opening can be suppressed. Furthermore, because the toner discharge opening is directed downward in the vertical direction, after the toner in the toner container is used, the amount of toner remaining near the toner discharge opening can be small because of the drop by gravity. Therefore, the toner stain in the toner discharge opening upon replacement of the toner container is reduced.

When the toner container is to be attached to the toner-container holding unit, a user first opens a main-body cover (a stack portion) upwardly, so that the toner-container holding unit is exposed. Then, the toner container is placed on the toner-container holding unit from the upper side of the toner-container holding unit. Thereafter, the user holds a handle integrally provided on the cap portion, and rotates the cap portion (rotating operation). With the rotating operation, the position of the toner container with respect to the toner-container holding unit is finally fixed. Furthermore, with the rotation of the cap portion, a shutter resists the biasing force of a spring so that the toner discharge opening is opened downwardly.

Japanese Patent Application Laid-open No. 2004-161371 discloses a toner storage container that includes a bag container and a cap member. A toner discharge opening of the cap member is opened/closed in synchronization with a part of the attachment/detachment operation of the toner container (rotating operation of an opening/closing holder), for reducing toner stain (toner scatter) occurring upon the attachment/detachment operation.

Specifically, when the toner container is attached to the apparatus body, the opening/closing holder is first rotated around a hinge and the upper side of the opening/closing holder is exposed. Then, the toner container is set in the opening/closing holder. Thereafter, the opening/closing holder with the toner container set therein is rotated (rotating operation) around the hinge. With the rotating operation, the position of the toner storage container is finally fixed in the apparatus body. Furthermore, a plug member (a shutter member) is pushed by a nozzle in response to the rotation of the opening/closing holder to resist the biasing force of a spring, to thereby open the toner discharge opening sealed by a packing (a G-seal).

The toner container disclosed in Japanese Patent Application Laid-open No. 2004-287404 has less toner stain in the toner discharge opening compared with that disclosed in Japanese Patent Application Laid-open No. 2000-338758, and therefore, the effect of preventing such a problem that a user's hand becomes stained with toner by touching the toner discharge opening is expected. However, the toner container disclosed in Japanese Patent Application Laid-open No. 2004-287404 has disadvantages in terms of operability/workability upon its attachment/detachment (replacement).

A first disadvantage is that the attachment/detachment operation of the toner container to/from the toner-container holding unit includes a plurality of operations such as an operation of opening/closing the main-body cover, an operation of placing/removing the toner container onto/from the toner-container holding unit, and an operation of rotating the cap portion.

A second disadvantage is that it is difficult for a user to check that the operation is performed properly nearly until the completion of the attachment operation. Specifically, the user cannot feel certain that the operation is performed correctly at the point when the operation of opening the main-body cover and the operation of placing the toner container on the toner-container holding unit are completed. Thereafter, when rotating the cap portion to fix the position of the cap portion, if the user can have a feeling of a click of the cap portion, the user can feel certain that no erroneous operation is made.

A third disadvantage is that the upper side of the toner-container holding unit is restricted in terms of layout. Specifically, to place the toner container in the toner-container holding unit from the upper side, the main-body cover needs to be opened/closed in the vertical direction. Therefore, it is necessary to ensure space required for layout to open/close the main-body cover and place/remove the toner container. This reduces operability/workability in attachment/detachment of the toner container if a scanner (a document reader) or the like is provided above the toner-container holding unit.

Furthermore, in the toner container in Japanese Patent Application Laid-open No. 2004-287404, the container body is rotated by the rotational force transmitted to the gear portion that is integrally provided on the container body and is made of a material same as that of the container body. Specifically, the gear portion and the container body are often formed of polyethylene terephthalate (PET) or the like that is suitable for blow molding. Generally, such material does not have high mechanical strength. Thus, when the toner container has a large capacity (e.g., the toner container has a length of 500 mm or longer in a longitudinal direction) and contains a large amount of toner, a load imposed on the gear portion becomes large, which may result in wear or damage of the gear portion. Because the toner container with a worn or damaged gear portion cannot be recycled even if there is no defect except the gear portion, the efficiency of recycling the toner container is reduced.

In the toner container described in Japanese Patent Application Laid-open No. 2004-161371, because the plug member is pushed by the nozzle in synchronization with the opening operation of the opening/closing holder, to open the toner discharge opening sealed by the packing, the effect of reducing occurrence of toner stain can be expected. However, this toner container also has some disadvantages in terms of operability/workability upon its attachment/detachment.

A first disadvantage is that because the capacity of the toner container cannot be increased, the frequency of replacement of the toner container increases. Specifically, the toner container has a bag container for containing toner. The longitudinal direction of the bag container is vertical. Therefore, if the capacity of the bag container is to be increased, the height of the toner container needs to be increased. This increases the height of the opening/closing holder, thereby affecting the layout of the image forming apparatus in the height direction. Thus, the capacity of the toner container cannot be increased so much, and the toner container needs to be replaced more frequency than the toner container disclosed in Japanese Patent Application Laid-open No. 2004-287404 in which the longitudinal direction thereof is horizontal.

A second disadvantage is that it is difficult for a user to feel certain that no erroneous operation is made. Specifically, because the plug member opens/closes the toner discharge opening in synchronization with the opening/closing operation of the opening/closing holder, it is difficult for the user to feel if the toner discharge opening is actually opened or closed because the user does not touch the toner storage container during the operation.

Because the toner is a consumable, which greatly affects the image quality, it is preferable that information related to the toner (toner properties) contained in the toner container, which is frequently replaced, be shared between the image forming apparatus and a control unit. To accomplish that, an electronic component storing the toner information is installed in the toner container. However, for replacing the toner container, when a user attaches/detaches the toner container without paying attention to the electronic component, the toner container may hit the apparatus body and the electronic component may be damaged. Particularly, in a large-sized apparatus in which a toner container with large capacity (e.g., a toner container whose length in a longitudinal direction is 500 mm or longer) is provided, the workability for replacing the toner container is reduced due to the size and the weight of the toner container compared with a small-sized apparatus. Therefore, the possibility of damaging the electronic component is not negligible.

SUMMARY OF THE INVENTION

It is an object of the present invention to at least partially solve the problems in the conventional technology.

A toner container according to one aspect of the present invention is configured to be attached to a toner-container holding unit of an image forming apparatus in a detachable manner. The toner container includes a container body that contains toner therein; and a cap portion that is held by the toner-container holding unit and that includes a toner discharge opening to discharge the toner contained in the container body. A gear portion that transmits a rotational force to the container body is attached to the container body in a detachable manner.

An image forming apparatus according to another aspect of the present invention includes a toner-container holding unit; and a toner container configured to be attached to the toner-container holding unit in a detachable manner. The toner container includes a container body that contains toner therein, and a cap portion that is held by the toner-container holding unit and that includes a toner discharge opening to discharge the toner contained in the container body. A gear portion that transmits a rotational force to the container body is attached to the container body in a detachable manner.

A toner container according to still another aspect of the present invention is configured to be attached to a toner-container holding unit of an image forming apparatus in a detachable manner. The toner container includes a container body that contains toner therein; and a cap portion that is held by the toner-container holding unit and that includes a toner discharge opening to discharge the toner contained in the container body. A plurality of packings are provided between the container body and the cap portion around the opening of the container body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

In the embodiments, a "process cartridge" is defined as a unit in which an image bearing body, and at least one of a charging unit that charges an image bearing body, a developing unit that develops a latent image formed on the image bearing body, and a cleaning unit that cleans a surface of the image bearing body are integrated, and which is detachably attached to an image forming apparatus.

Toner containers 32Y, 32M, 32C, and 32K according to a first embodiment of the present invention are explained referring to FIGS. 1 to 9.

Figure 1:
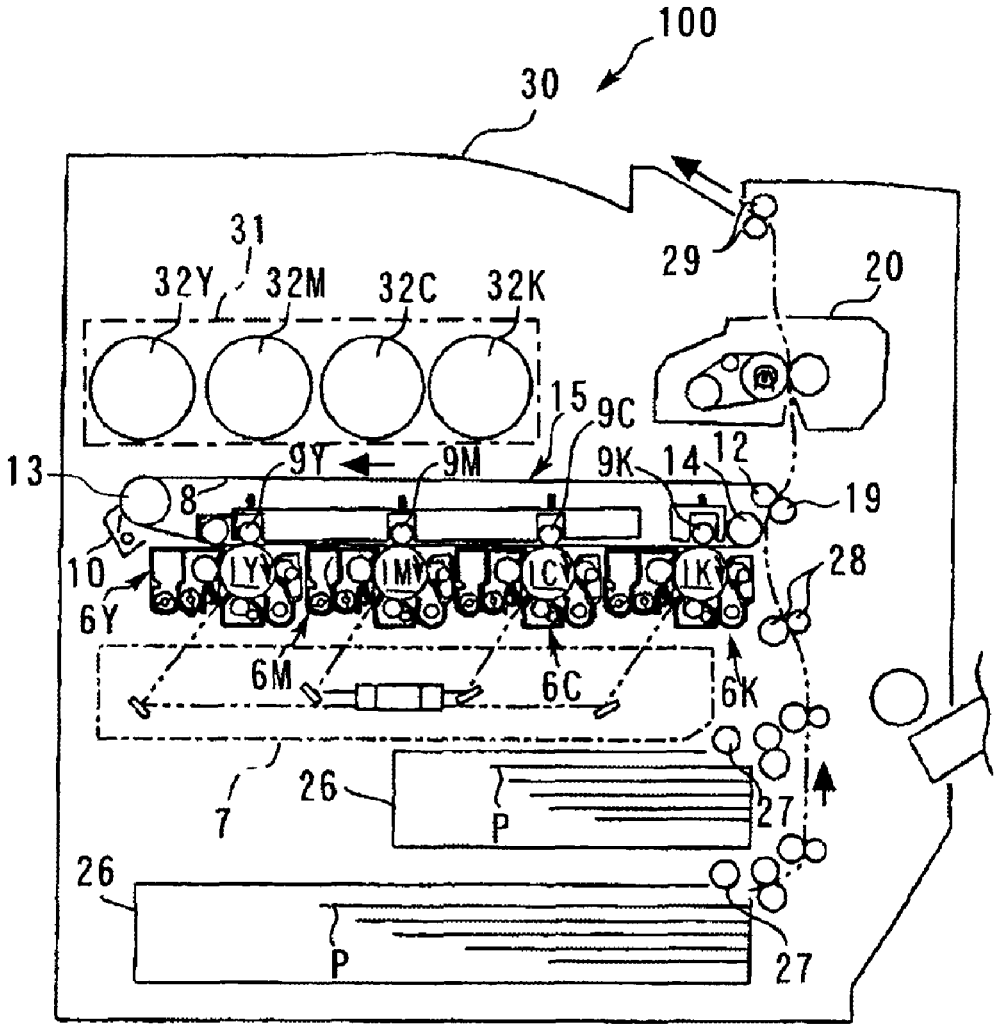
FIG. 1 is a schematic diagram of an image forming apparatus according to a first embodiment of the present invention.
Figure 2:
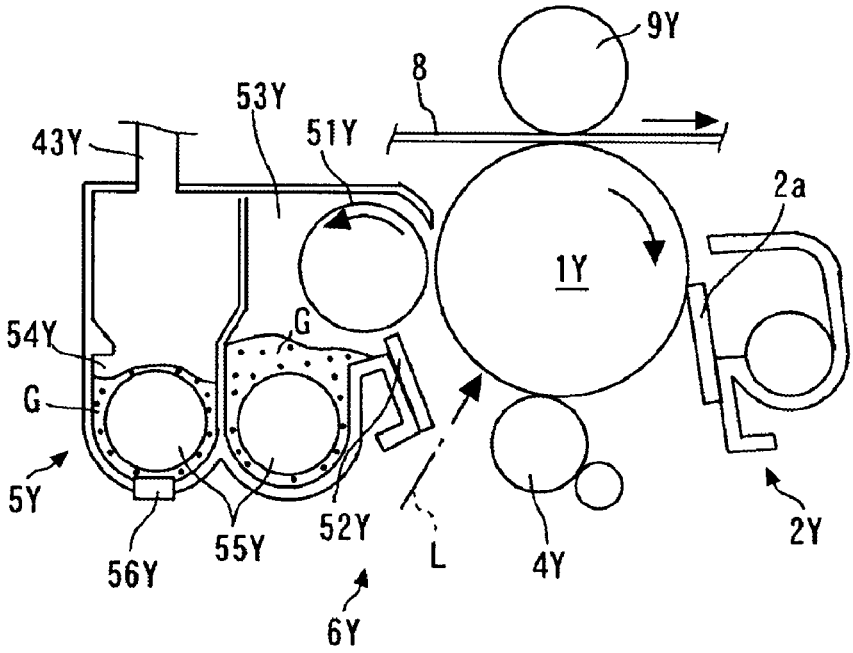
FIG. 2 is a schematic diagram of an image forming unit of the image forming apparatus shown in FIG. 1.
Figure 3:
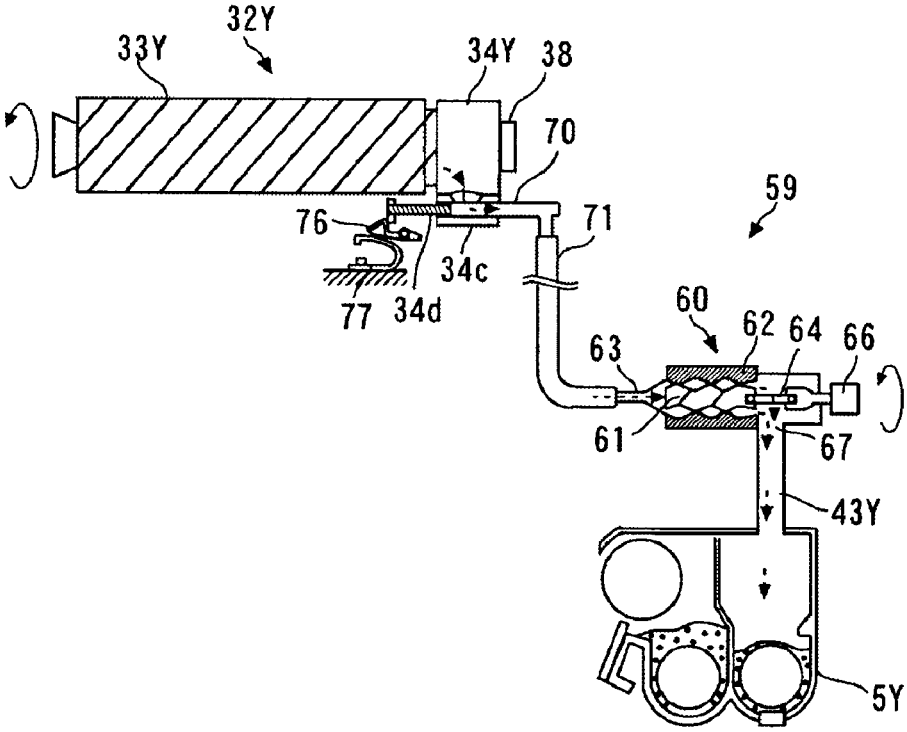
FIG. 3 is a schematic diagram representing a toner supply path of the image forming apparatus shown in FIG. 1.
Figure 4:
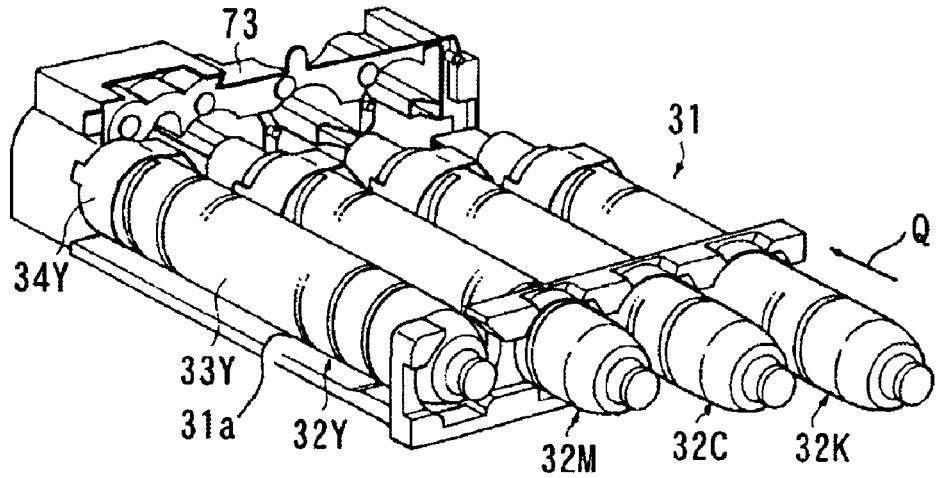
FIG. 4 is a perspective view representing a state where toner containers are attached to the toner-container holding unit.

FIG. 1 is a schematic diagram of an image forming apparatus 100 such as a printer, FIG. 2 is a schematic diagram of an image forming unit 6Y of the image forming apparatus 100, FIG. 3 is a schematic diagram representing a toner supply path of the image forming apparatus 100, and FIG. 4 is a perspective view representing a part of a toner supplying unit 59.

Figure 9:
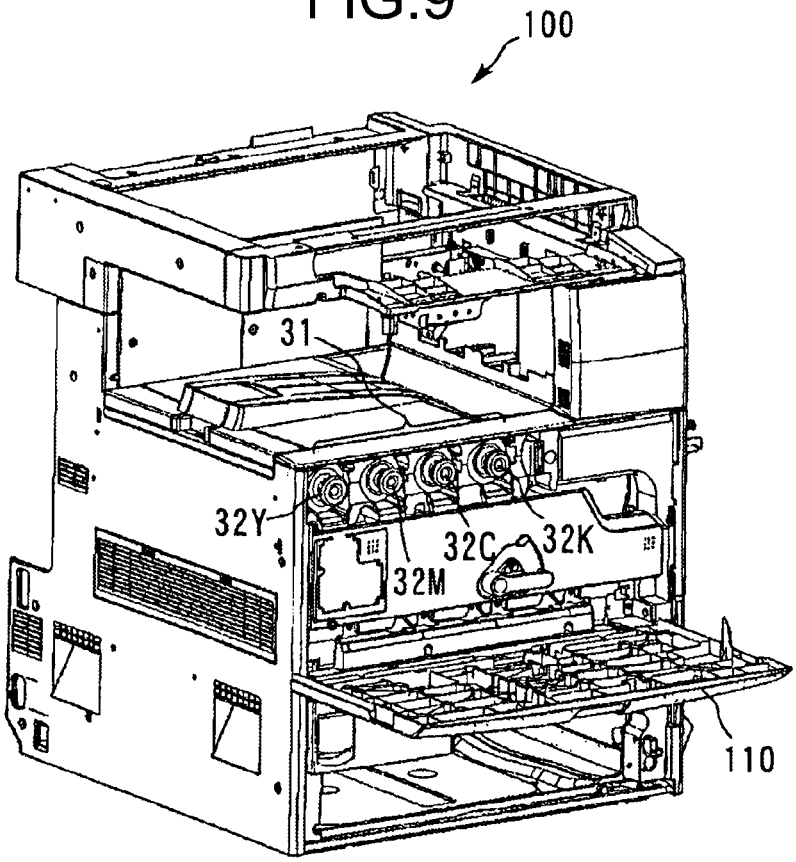
FIG. 9 is a perspective view of the image forming apparatus with a door thereof opened.

As shown in FIGS. 1 and 9, a toner-container holding unit 31 is arranged in the upper portion of the image forming apparatus 100, and the toner containers 32Y, 32M, 32C, and 32K corresponding to four colors (yellow, magenta, cyan, and black) are detachably (replaceably) attached to the toner-container holding unit 31.

An intermediate transferring unit 15 is arranged below the toner-container holding unit 31, and the image forming units 6Y, 6M, 6C, and 6K corresponding to the four colors (yellow, magenta, cyan, and black) are arranged in parallel to oppose an intermediate transferring belt 8 of the intermediate transferring unit 15.

As shown in FIG. 2, the image forming unit 6Y for yellow includes a photoconductive drum 1Y, a charging unit 4Y, a developing unit 5Y, a cleaning unit 2Y, and a neutralizing unit (not shown). The charging unit 4Y, the developing unit 5Y, the cleaning unit 2Y, and the neutralizing unit are arranged around the photoconductive drum 1Y. An image forming process including a charging process, an exposing process, a developing process, a transferring process, and a cleaning process is performed on the surface of the photoconductive drum 1Y, so that a yellow image is formed on the surface of the photoconductive drum 1Y.

The configuration of each of the image forming units 6M, 6C, and 6K is substantially the same as that of the image forming unit 6Y, and each of the image forming units 6M, 6C, and 6K forms an image with a corresponding color. The image forming unit 6Y is explained below as a representative of the image forming units 6Y, 6M, 6C, and 6K.

The photoconductive drum 1Y is driven to rotate clockwise in FIG. 2 by a drive motor (not shown), and the surface of the photoconductive drum 1Y is uniformly charged at the position opposing the charging unit 4Y (charging process).

Thereafter, when the uniformly-charged surface of the photoconductive drum 1Y reaches a position where the photoconductive drum 1Y is exposed to a laser beam L emitted from an exposing unit 7, the surface of the photoconductive drum 1Y is scanned by the laser beam L, whereby an electrostatic latent image corresponding to yellow is formed (exposing process).

Thereafter, when the latent-image-formed surface of the photoconductive drum 1Y reaches a position opposing the developing unit 5Y, the latent image is developed, so that a yellow toner image is formed (developing process).

Thereafter, when the toner-image-formed surface reaches a position opposing the intermediate transferring belt 8 and a primary transferring bias roller 9Y, the toner image is transferred onto the intermediate transferring belt 8 (primary transferring process). After the toner image is transferred, some untransferred toner remains on the surface of the photoconductive drum 1Y.

Thereafter, when the surface of the photoconductive drum 1Y on which some untransferred toner remains reaches a position opposing the cleaning unit 2Y, the untransferred toner is mechanically collected by a cleaning blade 2*a* (cleaning process).

Finally, the surface of the photoconductive drum 1Y with the untransferred toner removed reaches a position opposing the neutralizing unit, and residual potential on the photoconductive drum 1Y is removed.

In this manner, the image forming process on the photoconductive drum 1Y is completed.

An image forming process by each of the image forming units 6M, 6C, and 6K is performed in the above manner. Specifically, in each of the image forming units 6M, 6C, and 6K, the laser beam L based on image information is radiated from the exposing unit 7 provided below each of the image forming units 6M, 6C, and 6K, toward a photoconductive drum of each of the image forming units 6M, 6C, and 6K. More specifically, the exposing unit 7 emits the laser beam L from a light source, the laser beam L is deflected by a polygon mirror that is driven to rotate to be radiated to the surface of the photoconductive drum through a plurality of optical elements.

Then, respective color toner images formed on the photoconductive drums through the developing process are transferred and superposed onto the intermediate transferring belt 8, whereby a color image is formed on the intermediate transferring belt 8.

As shown in FIG. 1, the intermediate transferring unit 15 includes the intermediate transferring belt 8, the primary transferring bias rollers 9Y, 9M, 9C, and 9K, a secondary transferring backup roller 12, a cleaning backup roller 13, a tension roller 14, and an intermediate transferring cleaning unit 10. The intermediate transferring belt 8 is stretched over and supported by the secondary transferring backup roller 12, the cleaning backup roller 13, and the tension roller 14, and moves in a direction indicated by an arrow in FIG. 1 by driving the secondary transferring backup roller 12 to rotate.

The primary transferring bias rollers 9Y, 9M, 9C, and 9K nip the intermediate transferring belt 8 with the photoconductive drums 1Y, 1M, 1C, and 1K, to form primary transfer nips, respectively. A transfer bias with a polarity opposite to that of the toner is applied to the primary transferring bias rollers 9Y, 9M, 9C, and 9K.

The intermediate transferring belt 8 moves in the arrow direction in FIG. 1 and sequentially passes through the primary transfer nips of the primary transferring bias roller 9Y, 9M, 9C, and 9K, so that toner images of four colors are sequentially superposed on a predetermined part of the intermediate transferring belt 8 (primary transfer).

Thereafter, the predetermined part of the intermediate transferring belt 8 with a four-color toner image formed thereon reaches a secondary transfer nip formed between a secondary transferring roller 19 and the secondary transferring backup roller 12. At this time, a recording medium P on which an image is to be formed is conveyed to the secondary transfer nip in synchronization with the movement of the intermediate transferring belt 8 so that the four-color toner image is transferred onto the recording medium P. After the four-color toner image is transferred onto the recording medium P, some toner is not transferred onto the recording medium P and remains on the intermediate transferring belt 8.

Thereafter, the predetermined part of the intermediate transferring belt 8 reaches the intermediate transferring cleaning unit 10, at which the toner remaining on the intermediate transferring belt 8 is collected.

In this manner, a four-color toner image transferring process from the intermediate transferring belt 8 to the recording medium P is completed.

The recording medium P is fed from a sheet feeding unit 26 arranged in the lower portion of the image forming apparatus 100, and is conveyed to the secondary transfer nip by a feed roller 27, a registration roller pair 28, and the like.

Specifically, a plurality of recording mediums P are stored in the sheet feeding unit 26. When the feed roller 27 is driven to rotate counterclockwise in FIG. 1, the top recording medium P is picked up by the feed roller 27 and is fed toward the registration roller pair 28.

The recording medium P conveyed to the registration roller pair 28 is temporarily stopped at the registration roller pair 28 that is not driven to rotate. The registration roller pair 28 is driven to rotate in synchronization with the movement of the intermediate transferring belt 8 on which the four-color toner image is formed, and the recording medium P is conveyed to the second transfer nip. Whereby, the four-color toner image is transferred onto the recording medium P.

Thereafter, the recording medium P with the four-color toner image transferred thereon in the secondary transfer nip is conveyed to a fixing unit 20. The four-color toner image on the recording medium P is fixed thereon by heat and pressure by a fixing roller and a pressing roller in the fixing unit 20.

Thereafter, the recording medium P is discharged onto a stack portion 30 by a sheet discharging roller 29. In this manner, an image forming process in the image forming apparatus is completed.

As shown in FIG. 2, the developing unit 5Y includes a developing roller 51Y opposing the photoconductive drum 1Y, a doctor blade 52Y opposing the developing roller 51Y, conveying screws 55Y provided in developer containing portions 53Y and 54Y, and a toner concentration detecting sensor 56Y that detects a toner concentration in a developer. The developing roller 51Y includes a magnet that is fixed inside thereof, and a sleeve that rotates around the magnet. A two-component developer G including carrier and toner is contained in each of the developer containing portions 53Y and 54Y. The developer containing unit 54Y communicates with a toner conveying pipe 43Y through an opening formed in the upper surface of the developer storing unit 54Y.

The sleeve of the developing roller 51Y rotates in a direction indicated by an arrow in FIG. 2. The developer G carried on the developing roller 51Y due to the magnetic field formed by the magnet adheres to the sleeve.

The developer G is adjusted so that the proportion of the toner (toner concentration) in the developer G is within a predetermined range. Specifically, the toner is supplied into the developer containing portion 54Y via the toner supplying unit 59 (see, FIG. 3) from the toner container 32Y according to the consumed amount of toner in the developing unit 5Y.

The toner supplied into the developer containing portion 54Y circulates in the developer containing portions 53Y and 54Y (in a direction perpendicular to the drawing plane of FIG. 2) while being mixed and stirred with the developer G by the conveying screws 55Y. The toner in the developer G is attracted to the carrier due to the frictional electrification with the carrier, and is carried on the developing roller 51Y together with the carrier due to the magnetic field formed on the developing roller 51Y.

The developing roller 51Y carrying the developer G rotates in the arrow direction in FIG. 2, and the amount of the developer G on the developing roller 51Y is adjusted by the doctor blade 52Y. Thereafter, the toner of the developer G on the developing roller 51Y is attracted to the surface of the photoconductive drum 1Y to correspond to the latent image formed thereon due to the electrical field formed in the developing area where the developing roller 51Y opposes the photoconductive drum 1Y. Thereafter, as the sleeve further rotates, the developer G remaining on the developing roller 51Y is conveyed to the high position in the developer containing portion 53Y, and then is removed from the developing roller 51Y.

In FIG. 3, for easy understanding, the arrangement directions of the toner container 32Y, the developing unit 5Y, and a toner supply path including a nozzle 70, a tube 71, a screw pump 60, and the toner conveying pipe 43Y, are changed. Actually, the longitudinal directions of the toner container 32Y and a part of the toner supply path match the direction perpendicular to the drawing plane of FIG. 3.

As shown in FIGS. 4 and 9, the toner in each of the toner containers 32Y, 32M, 32C, and 32K arranged in the toner-container holding unit 31 is supplied to the developing unit for a corresponding color through the toner supply path for a corresponding color according to the amount of toner consumed. The toner supply paths for the four colors have substantially the same configuration.

Specifically, as shown in FIG. 3, when the toner container 32Y is set in the toner-container holding unit 31, one end of the nozzle 70 of the toner-container holding unit 31 is connected to a cap portion 34Y of the toner container 32Y. At this time, a plug member 34*d* (an opening/closing member) of the toner container 32Y opens a toner discharge opening of the cap portion 34Y while being held between the nozzle 70 and a claw member 76 that is biased by a plate spring 77. Thus, the toner contained in a container body 33Y of the toner container 32Y is conveyed into the nozzle 70 through the toner discharge opening.

The other end of the nozzle 70 is connected to one end of the tube 71 as a conveyor tube whose other end is connected to the screw pump 60 (a mohno pump) of the toner supplying unit 59.

The tube 71 is formed to have an inner diameter of 4 mm to 10 mm. The tube 71 is made of a flexible material with excellent toner-resistance. For example, the tube 71 is made of rubber such as polyurethane, nitrile, ethylene propylene diene monomer (EPDM), and silicone, or a resin material such as polyethylene and nylon. The flexible tube 71 increases the flexibility of the layout of the toner supply path, enabling the image forming apparatus 100 to be small.

The screw pump 60 is a suction-type uniaxial-eccentric screw pump, and includes a rotor 61, a stator 62, a suction opening 63, a universal joint 64, and a motor 66. The rotor 61, the stator 62, and the universal joint 64 are accommodated in a casing (not shown). The stator 62 is made of an elastic material such as rubber, and is formed with a double-pitch spiral groove. The rotor 61 is a shaft member made of a rigid material such as metal, and is formed with a spiral male thread. The rotor 61 is inserted into the groove in the stator 62, and is connected to the motor 66 via the universal joint 64 at one end, in a rotatable manner.

The screw pump 60 constructed in the above manner generates a suction force at the suction opening 63 by driving the rotor 61 in the stator 62 to rotate by the motor 66 in a predetermined direction (counterclockwise as seen from an upstream side in a toner conveying direction). That is, the screw pump 60 generates a negative pressure in the tube 71 by sending air into the tube 71. This allows the toner in the toner container 32Y to be suctioned into the suction opening 63 via the tube 71 together with the air. The toner suctioned into the suction opening 63 is sent into a gap between the stator 62 and the rotor 61 to be sent out to the other end of the rotor 61 with the rotation of the rotor 61. The toner sent out is discharged from a feed opening 67 in the screw pump 60 to be supplied into the developing unit 5Y through the toner conveying pipe 43Y as indicated by an arrow of a dotted line in FIG. 3.

As shown in FIGS. 1, 4, and 9, the substantially cylindrical toner containers 32Y, 32M, 32C, and 32K are detachably attached to the toner-container holding unit 31. Each of the toner containers 32Y, 32M, 32C, and 32K is replaced by a new one when all toner therein is consumed. The toners of different colors contained in the toner containers 32Y, 32M, 32C, and 32K are supplied into the developing units of the image forming units 6Y, 6M, 6C, and 6K through the toner supply paths explained in FIG. 3, respectively.

Figure 5:
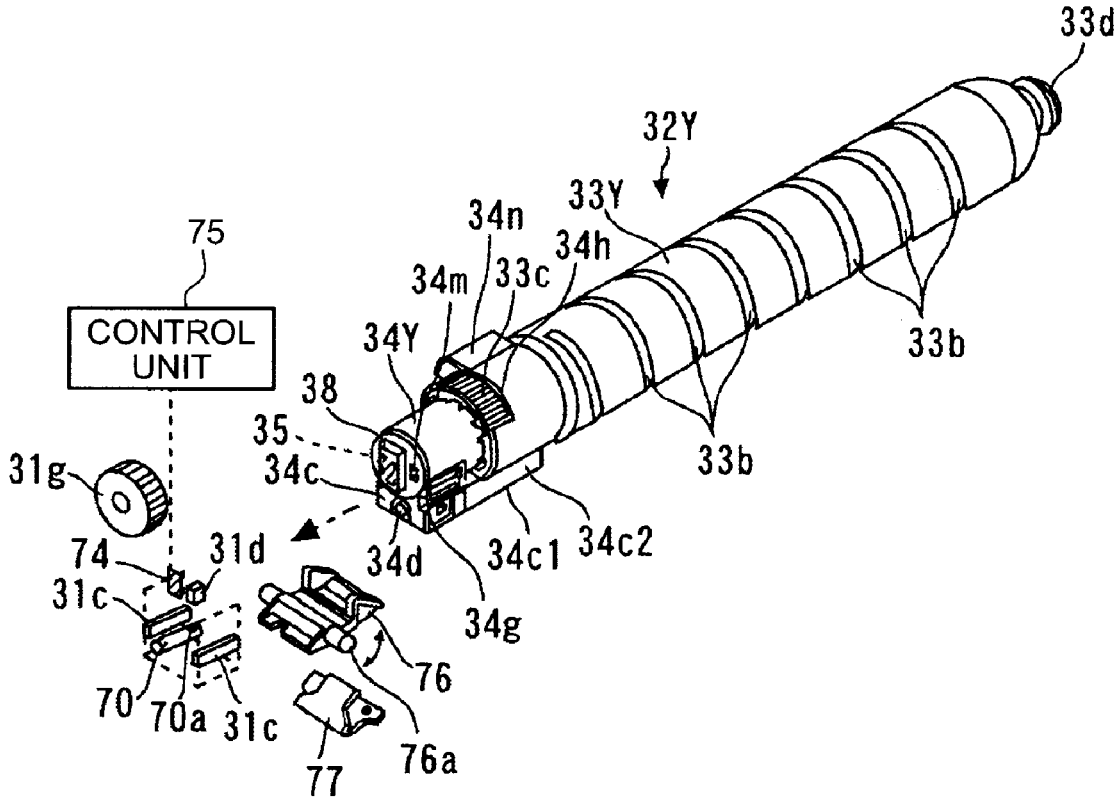
FIG. 5 is a perspective view of the toner container to be attached to the toner-container holding unit.
Figure 6:
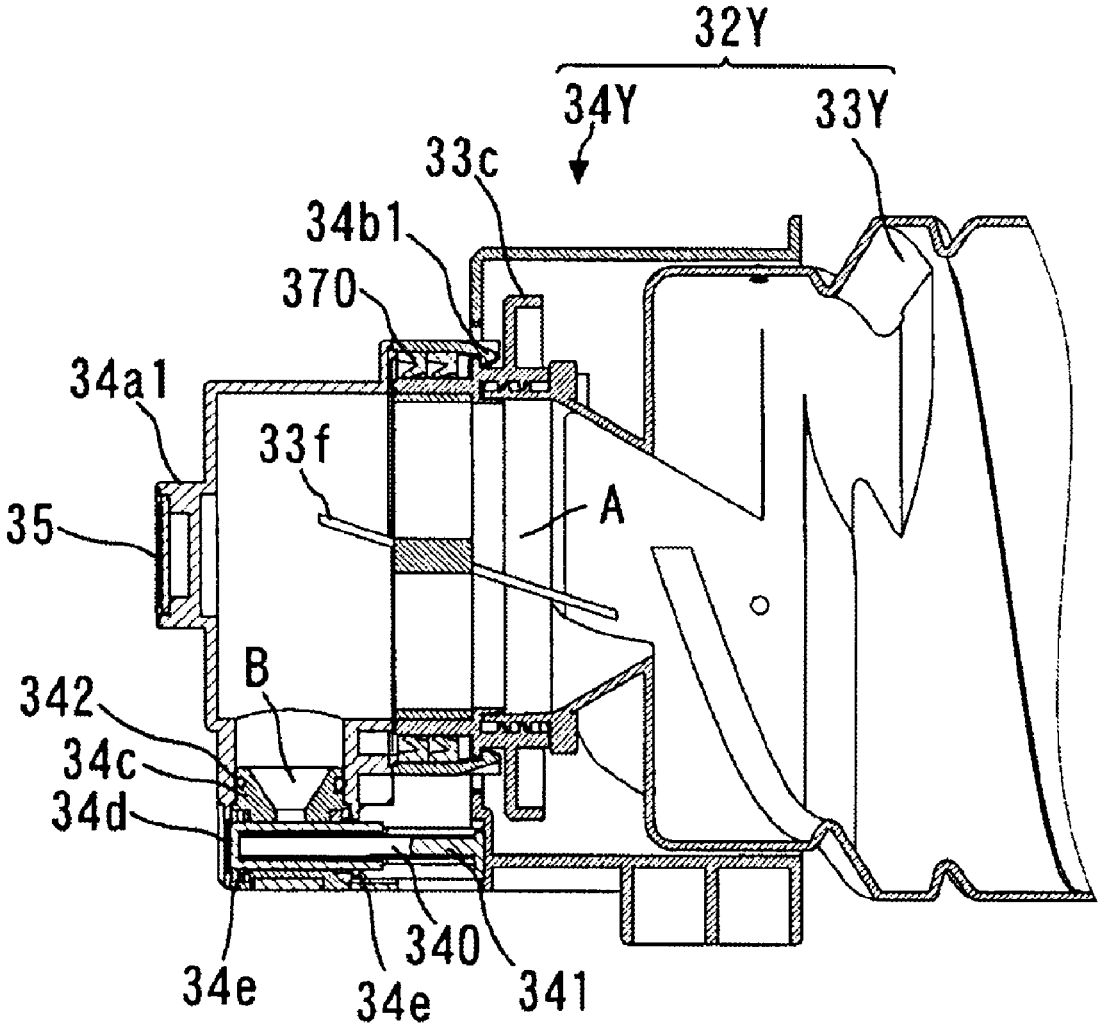
FIG. 6 is a cross section of a head portion of the toner container.

FIG. 5 is a perspective view of the toner container 32Y, and FIG. 6 is a cross section of a head portion of the toner container 32Y (a portion of the toner container 32Y on the side where the cap portion 34Y is provided).

Each of the toner containers 32M, 32C, and 32K has the same configuration as the toner container 32Y except the positions of a recess 34*m* and a projection 34*n*. The toner container 32Y is explained below as a representative of the toner containers 32Y, 32M, 32C, and 32K.

As shown in FIG. 5, the toner container 32Y includes the container body 33Y and the cap portion (a bottle cap) 34Y attached to the head portion of the container body 33Y. A gear portion 33*c* is provided on the head portion of the container body 33Y, and an opening A is formed in the head portion of the container body 33Y (see, FIG. 6). The gear portion 33*c* rotates integrally with the container body 33Y. The toner contained in the container body 33Y is discharged toward the space in the cap portion 34Y through the opening A. When attaching the toner container 32Y to the toner-container holding unit 31, the toner container 32Y is inserted into the toner-container holding unit 31 from the head portion of the container body 33Y.

The gear portion 33*c* meshes with a drive gear 31*g* of a driving unit provided in the toner-container holding unit 31, so that the rotational force is transmitted from the driving unit to the container body 33Y and the container body 33Y is rotated centering around the rotation axis. Specifically, a part of the gear portion 33*c* is exposed from a cutout 34*h* formed in the cap portion 34Y, and the gear portion 33*c* meshes with the drive gear 31*g*. Thus, the rotation force is transmitted from the drive gear 31*g* to the gear portion 33*c*, and the container body 33Y is rotated in a predetermined direction. In the first embodiment, the drive gear 31*g* and the gear portion 33*c* are both spur gears.

As shown in FIG. 5, the container body 33Y includes a gripper 33*d* on the rear portion thereof. A user grips the gripper 33*d* for the attachment/detachment operation of the toner container 32Y.

A spiral protrusion 33*b* is formed on the inner circumferential surface of the container body 33Y. In other words, a spiral groove is formed on the outer circumferential surface of the container body 33Y. When the container body 33Y is driven to rotate in the predetermined direction, the toner in the container body 33Y follows the spiral protrusion 33*b* and is discharged from the opening A. The container body 33Y except the gear portion 33*c* can be manufactured by blow molding.

A rod-like stirring member 33*f*, which rotates together with the container body 33Y, is provided at the opening A of the toner container 32Y. The stirring member 33*f* extends from the space in the cap portion 34Y toward the inside of the container body 33Y and inclines with respect to the rotation axis of the container body 33Y. Because the stirring member 33*f* rotates together with the container body 33Y, the efficiency of discharging the toner from the opening A is improved.

The container body 33Y is rotated counterclockwise as seen from the upstream side in the toner conveying direction, and the spiral of the spiral protrusion 33*b* is right-handed.

As shown in FIGS. 5 and 6, the cap portion 34Y includes a holder 34*c*, a plug member 34*d* (a shutter) that serves as an opening/closing member, a packing 34*e*, and an IC chip 35 as an electronic component. As shown in FIG. 5, engaging portions (grooves) 34*g*, with which positioning members 31*c* of the toner-container holding unit 31 are engaged, are provided on both sides of the cap portion 34Y. The recess 34*m*, into which a fitting member 31*d* of the toner-container holding unit 31 is fitted, is provided on the end surface of the cap portion 34Y. The projection 34*n*, which is fitted into a fitting member (not shown) of the toner-container holding unit 31, is provided on the circumferential surface of the cap portion 34Y. The cutout 34*h*, from which a part of the gear portion 33*c* is exposed, is provided in the upper side of the cap portion 34Y.

The cap portion 34Y is communicated with the container body 33Y through the opening A, and the toner discharged from the opening A is discharged from a toner discharge opening B formed in the cap portion 34Y.

The cap portion 34Y has a substantially cylindrical space and a mortar shaped space. The mortar shaped space serves as a toner discharging path (vertical path) from the cylindrical space to the toner discharge opening B. With such a shape, a spiral airflow formed in the container body 33Y by the rotation of the container body 33Y is maintained, whereby the toner is efficiently conveyed toward the toner discharge opening B. Therefore, the toner discharged from the toner discharge opening B moves in the tube 71 more efficiently.

The cap portion 34Y is held by a holding portion 73 (see, FIG. 4) of the toner-container holding unit 31 in a state where the cap portion 34Y does not rotate together with the container body 33Y and the engaging portions 34*g* are engaged with the positioning members 31*c*.

The cap portion 34Y includes a claw 34*b*1. The claw 34*b*1 is engaged with an engaging member formed on the head portion of the container body 33Y (the gear portion 33*c*), so that the container body 33Y is held by the cap portion 34Y to be rotatable with respect to the cap portion 34Y. The claw 34*b*1 and the engaging member are engaged with each other with an appropriate clearance therebetween so that the container body 33Y is driven to rotate smoothly.

The holder 34*c* is provided on the lower side of the cap portion 34Y, and is provided with the plug member 34*d*. The plug member 34*d* is an opening/closing member for opening/closing the toner discharge opening B in synchronization with the attachment/detachment operation of the toner container 32Y.

Figure 7:
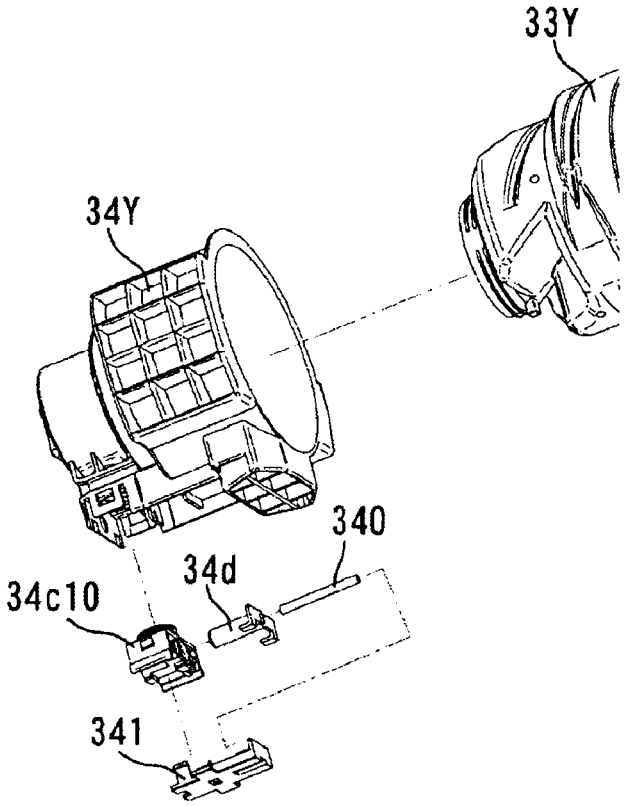
FIG. 7 is an exploded perspective view of a cap portion of the toner container.

Specifically, as shown in FIGS. 6 and 7, the holder 34*c* is detachably attached to the cap portion 34Y, and includes a holder main part 34*c*10, a holder cover 341, the plug member 34*d*, and a compression spring 340 that functions as a biasing member. A toner discharge opening and a through hole communicating with the toner discharge opening are formed in the holder main part 34*c*10. The plug member 34*d* is inserted into one end of the through hole (the nozzle 70 is inserted into the other end of the through hole). Furthermore, the compression spring 340 is attached from the rear side of the plug member 34*d*. In such a state, the holder main part 34*c*10, the plug member 34*d*, and the compression spring 340 are held onto the cap portion 34Y by the holder cover 341. Because the holder main part 34*c*10 is held on the cap portion 34Y via an O-ring 342, the toner is prevented from scattering from the outer circumferential surface of the holder main part 34*c*10. As shown in FIG. 6, because a blind hole that guides a part of the compression spring 340 is formed in the plug member 34*d*, buckling of the compression spring 340 is suppressed.

Because the toner container 32Y is provided with the compression spring 340, which presses the plug member 34*d* in a direction that closes the toner discharge opening, the toner container 32Y itself can reliably close the toner discharge opening by the plug member 34*d*, whereby the toner is surely prevented from scattering.

As shown in FIG. 6, two of a packing 370, such as two G-seals, are provided in a row to seal a gap formed between the opposing surfaces of the container body 33Y and the cap portion 34Y around the opening A. Even if the container body 33Y is eccentrically attached to the cap portion 34Y or the container body 33Y is driven to rotate eccentrically with respect to the cap portion 34Y, lip portions (rubber portions) of the packings 370 follow the movement of the container body 33Y and wear little over time. Thus, the sealing properties between the container body 33Y and the cap portion 34Y are stably improved. Particularly, because a plurality of the packings 370 are provided, the improvement of the sealing properties is remarkable.

As shown in FIG. 6, the packings 370 are arranged so that a tip of a lip portion of each packing 370, which makes contact with the periphery of the container body 33Y, is inclined in such a manner that an inner diameter of the lip portion becomes smaller toward the opening A of the container body 33Y (right side in FIG. 6). In other words, the tip of the lip portion is inclined toward the side on which the toner is contained (the side opposite to the side on which the toner should not be scattered). Thus, the sealing properties between the container body 33Y and the cap portion 34Y by the packings 370 are improved.

The packings 370 are arranged so that tips of the lip portions are inclined in the same direction. Therefore, when the cap portion 34Y is attached to the container body 33Y, the lip portion does not roll up easily.

Figure 8:
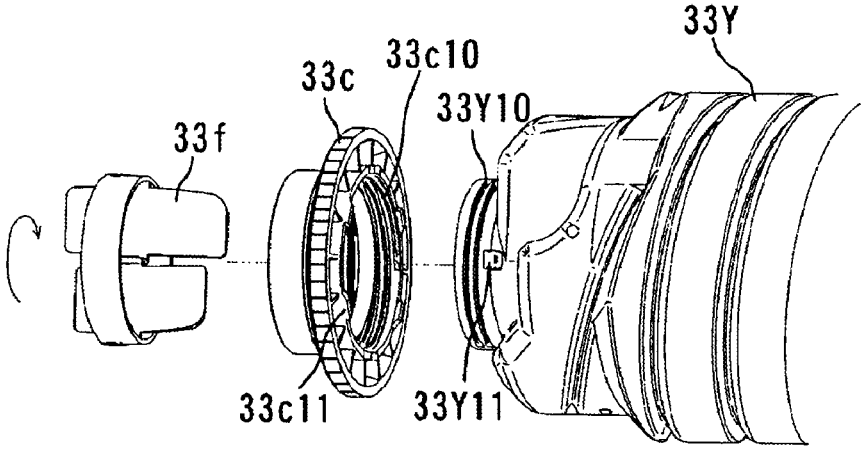
FIG. 8 is an exploded perspective view of a container body of the toner container.

As shown in FIGS. 6 and 8, the gear portion 33*c*, which transmits the rotational force to the container body 33Y, is detachably attached to the container body 33Y. In other words, the gear portion 33*c* is not integrally formed with the container body 33Y, and is screwed into the container body 33Y as a separate member.

Specifically, as shown in FIG. 8, the gear portion 33*c* is provided with a spur gear on the outer circumferential surface, and a thread groove 33*c*10 on the inner circumferential surface. The stirring member 33*f* is fitted into the inner circumferential surface of the gear portion 33*c*, and the thread groove 33*c*10 is screwed into a screw thread 33Y10 formed on the outer circumferential surface of the opening portion of the container body 33Y. At this time, when a projection 33*c*11 formed on the inner circumferential surface of the gear portion 33*c* slides over a projection 33Y11 formed on the container body 33Y, the position of the gear portion 33*c* with respect to the container body 33Y is determined. With the provision of the projections 33*c*11 and 33Y11, the gear portion 33*c* attached to the container body 33Y is prevented from being detached from the container body 33Y.

The thread groove 33*c*10 and the screw thread 33Y10 are formed such that the direction in which the thread groove 33*c*10 is screwed into the screw thread 33Y10 matches the rotational direction of the container body 33Y. Thus, the rotational force is surely transmitted from the gear portion 33*c* to the container body 33Y, and it is prevented that when the container body 33Y is driven to rotate, the meshing of the screw thread 33Y10 and the thread groove 33*c*10 is loosened, and the gear portion 33*c* is detached from the container body 33Y.

The container body 33Y and the gear portion 33*c* are made of different materials. Specifically, the container body 33Y is made of plastic such as PET that is suitable for blow molding, and the gear portion 33*c* is made of an engineering plastic material such as polyacetal (POM) for ensuring sufficient mechanical strength. Thus, even if the container body 33Y has a large capacity and contains a large amount of toner, and a load imposed on the gear portion 33*c* increases, such a problem that a tooth surface of the gear portion 33*c* wears out or breaks can be reduced.

The number of threads of each of the thread groove 33*c*10 and the screw thread 33Y10 is preferably two or more. In this embodiment, the number of threads is set to two. This reduces such a problem that the gear portion 33*c* is attached to the container body 33Y in an inclined state. When the number of threads is one, upon attaching the gear portion 33*c* to the container body 33Y, the gear portion 33*c* may be inclined with respect to the container body 33Y depending upon the screw pitch.

Because the gear portion 33*c* and the container body 33Y can be separate members, the following requirements can be satisfied. That is, for example, to manufacture the gear portion 33*c* with higher precision than that of the container body 33Y, to recycle the container body 33Y by replacing only the gear portion 33*c*, which often wears out mechanically, and to manufacture the gear portion 33*c*, which often wears out mechanically, with a material having a mechanical strength higher than that of the container body 33Y.

As shown in FIG. 5, when the toner container 32Y is attached to the toner-container holding unit 31, the IC chip 35 as an electronic component is positioned to oppose a communication circuit 74 of the toner-container holding unit 31 with a predetermined distance therebetween. Specifically, the IC chip 35 is attached to a surface of a projection 34*a*1 of the cap portion 34Y that is substantially perpendicular to an attachment direction (indicated by an arrow in FIG. 5) of the toner container 32Y to the toner-container holding unit 31. The IC chip 35 performs noncontact communication (wireless communication) with the communication circuit 74 in a state where the cap portion 34Y is held by the toner-container holding unit 31.

The IC chip 35 prestores various pieces of information related to the toner container 32Y and the toner contained in the toner container 32Y. The communication circuit 74 sends/receives the information to/from the IC chip 35 through wireless communication in a state where the toner container 32Y is set to the toner-container holding unit 31. Specifically, the information stored in the IC chip 35 is transmitted to a control unit 75 (see, FIG. 5) of the image forming apparatus 100 via the communication circuit 74, or the information of the image forming apparatus 100 obtained by the control unit 75 is transmitted to and stored in the IC chip 35.

The IC chip 35 stores information related to a toner such as a toner color, a serial number of a toner (production lot), and a date of toner production, and information related to recycling of a toner container such as the number of recycling, a date of recycling, and a recycling manufacturer. When the toner container 32Y is set to the toner-container holding unit 31, the information stored in the IC chip 35 is transmitted to the control unit 75 via the communication circuit 74. Thus, the image forming apparatus 100 is appropriately controlled based on the information received. For example, when the toner color is not the one that should be set in toner-container holding unit 31, the toner supplying unit 59 is stopped or the image forming condition is changed according to the serial number of the toner, or the recycling manufacturer.

The cap portion 34Y includes a protection cap 38 as a protection member that covers the entire surface of the IC chip 35 opposing the communication circuit 74. The protection cap 38 is made of resin, which has a sufficient strength and is thinned to the extent not to interfere with the communication between the IC chip 35 and the communication circuit 74. With such a configuration, even when a user carelessly causes the toner container 32Y to hit the image forming apparatus 100 during operation of replacing the toner container 32Y, the IC chip 35 is prevented from being damaged while maintaining the communication function of the IC chip 35.

The holder 34*c* includes a first sliding portion 34*c*1 and a second sliding portion 34*c*2. When the toner container 32Y is attached/detached to/from the toner-container holding unit 31, the first and second sliding portions 34*c*1 and 34*c*2 slide along the toner-container holding unit 31.

Specifically, the first sliding portion 34*c*1 is a flat portion formed to be parallel with a sliding surface 31*a* of the toner-container holding unit 31, and is provided on the bottom portion of the cap portion 34Y with which the attachment/detachment operation is performed. Furthermore, the second sliding portion 34*c*2 is a flat portion formed to be parallel with a sliding face (a side surface) of the toner-container holding unit 31, and is provided on the side portion of the cap portion 34Y with which the attachment/detachment operation is performed.

As shown in FIG. 5, the recess 34*m* is formed near the projection 34*a*1 on the end surface of the cap portion 34Y. When the cap portion 34Y is properly attached to the toner-container holding unit 31, the fitting member 31*d* is fitted into the recess 34*m*.

Thus, it is prevented that a toner container for an inappropriate color (e.g., toner container for yellow) is set in a toner-container holding unit at the position for a predetermined color (e.g., toner container for cyan), and a desired color image cannot be formed.

As shown in FIG. 5, the projection 34*n*, which is fitted into a fitting member (not shown) of the toner-container holding unit 31, is provided on the circumferential surface of the cap portion 34Y. In the same manner as the recess 34*m*, when the cap portion 34Y is properly attached to the toner-container holding unit 31, the projection 34*n* is fitted into the fitting member. Although not shown, the projection 34*n* is positioned at a different position depending upon a toner container (a container body) of each color.

Such a configuration prevents erroneous arrangement of the toner container in the toner-container holding unit in the same manner as the recess 34*m*.

Upon the setting of the toner container 32Y to the toner-container holding unit 31, the claw member 76 (see, FIG. 5) is engaged with the right edge of the plug member 34*d*. The claw member 76 functions as a biasing member by receiving a biasing force from the plate spring 77 (the second biasing member) and biases the plug member 34*d* in the direction that closes the toner discharge opening B.

As a toner contained in the toner containers 32Y, 32M, 32C, and 32K, the toner satisfying the following inequations is used, $$3 \leqq Dv \leqq 8 \quad (1)$$

$$1.00 \leqq Dv/Dn \leqq 1.40 \quad (2)$$

where Dv (μm) is a volume average particle size, and Dn (μm) is a number average particle size. Therefore, toner particles are selected according to an image pattern in the developing process and excellent image quality is maintained, and satisfactory developing property is maintained even if the toner is stirred for a long time in the developing unit. Furthermore, the toner can be efficiently and reliably conveyed without blocking the toner supply path such as the tube 71.

The volume average particle size and the number average particle size of the toner can be measured by using a typical device such as a Coulter Counter type particle size distribution measuring device "Coulter Counter-TA-II" (manufactured by Coulter Electronics Limited) and "Coulter Multisizer II" (manufactured by Coulter Electronics Limited).

Furthermore, as a toner contained in the toner containers 32Y, 32M, 32C, and 32K, substantially spherical toner, which is formed so that a shape factor SF-1 is in a range of 100 to 180 and a shape factor SF-2 is in a range of 100 to 180, is used. This suppresses reduction in cleaning performance while high transfer efficiency is maintained. Furthermore, the toner can be efficiently and reliably conveyed without blocking the toner supply path such as the tube 71.

The shape factor SF-1 indicates the sphericity of a toner particle, and is determined by $$SF\text{-}1=(M^2/S)\times(100\pi/4)$$

where M is the maximum particle size (the largest particle size in uneven particle sizes) in a project plane of the toner particle, and S is a project area of the toner particle. Therefore, the toner particle whose shape factor SF-1 is 100 is perfectly spherical, and the degree of sphericity lowers as it becomes greater than 100.

The shape factor SF-2 indicates the irregularities of a toner particle, and is determined by $$SF\text{-}2=(N^2/S)\times(100/4\pi)$$

where N is a circumferential length in the project plane of the toner particle, and S is the project area of the toner particle. Therefore, the toner particle whose shape factor SF-2 is 100 has no irregularities, and the irregularities become larger as it becomes greater than 100.

The shape factors SF-1 and SF-2 are obtained by analyzing a photograph of the toner particle taken by a scanning electron microscope "S-800" (manufactured by Hitachi, Ltd.) with an image analyzer "LUSEX3" (manufactured by NIRECO Corporation).

As shown in FIG. 9, when the toner container 32Y is attached to the toner-container holding unit 31 of the image forming apparatus 100, first, a cover 100 provided on the front side of the image forming apparatus 100 is opened to expose the toner-container holding unit 31.

Then, the toner container 32Y is pushed into the toner-container holding unit 31 from the cap portion 34Y side along the longitudinal direction of the container body 33Y (the toner container 32Y).

At this time, while the first sliding portion 34*c*1 slides along the sliding surface 31*a*, a user grips the gripper 33*d* on the rear portion of the toner container 32Y. Thus, the toner container 32Y is pushed into the toner-container holding unit 31 with good balance.

Thereafter, when the holder 34*c* reaches the holding portion 73, the second sliding portion 34*c*2 starts to slide along the sliding surface (a side surface) of the toner-container holding unit 31 for positioning the cap portion 34Y. Specifically, the engaging portions 34*g* and the positioning members 31*c* starts to engage with each other. During this time, an arm pair (not shown) biases the cap portion 34Y toward the holding portion 73.

Furthermore, during this time, the claw member 76 provided in the holding portion 73 is retracted to the position where the attachment of the cap portion 34Y is not obstructed. Specifically, the claw member 76 rotates in a direction indicated by a two-headed arrow in FIG. 5 centering around a rotational spindle 76*a*. More specifically, the claw member 76 is pushed down by the sliding portion 34*c*1 in the direction that resists the biasing force of the plate spring 77.

Thereafter, when the attachment operation of the toner container 32Y is further progressed, the plug member 34*d* starts to open the toner discharge opening B while the engaging portions 34*g* and the positioning members 31*c* are engaged with each other. Specifically, the plug member 34*d* is pushed by the nozzle 70 with the insertion of the front end of the nozzle 70 into the hole of the holder 34*c*.

At this time, the claw member 76 rotates from the retracted position to the position where the claw member 76 is engaged with the plug member 34*d*. Specifically, the claw member 76 is released from the pushing force of the sliding portion 34*c*1 and is pushed up to its default position by the biasing force of the plate spring 77.

At this time, the plug member 34*d* is held by the nozzle 70 and the claw member 76, and the position of the plug member 34*d* is fixed in the toner-container holding unit 31 (the holding portion 73). If the toner container 32Y is further moved in the attachment direction, the toner discharge opening B is opened while the position of the plug member 34*d* is fixed. That is, the plug member 34*d* relatively moves.

Then, the position of the cap portion 34Y is fixed at the position (contact reference position) where the holder 34*c* comes into contact with the holding portion 73, and at the same time, the plug member 34*d* fully opens the toner discharge opening B and the gear portion 33*c* meshes with the drive gear 31*g*. The IC chip 35 faces the communication circuit 74 at the position where wireless communication is possible. Furthermore, the recess 34*m* and the projection 34*n* for ensuring incompatibility with other toner containers are fitted into the fitting members of the apparatus body. The toner discharge opening B communicates with the toner supply opening 70*a* in the nozzle 70, and the attachment operation of the toner container 32Y is completed.

When the toner container 32Y is taken out (detached) from the toner-container holding unit 31, the operation is performed in the reverse manner of the attachment operation.

First, in synchronization with the separation operation (detachment operation) of the toner container 32Y from the holding portion 73, the plug member 34*d* is biased by the claw member 76 while the position of the plug member 34*d* is fixed in the holding portion 73 by the nozzle 70 and the claw member 76, to close the toner discharge opening B. At this time, the end surface of the plug member 34*d* is fitted into the fitting portion formed on the cap portion 34Y, and the toner discharge opening B is closed. Thereafter, when the toner container 32Y further moves in the separating direction, the claw member 76 moves to the position where the separation of the cap portion 34Y is not obstructed. After the cap portion 34Y is completely separated, the claw member 76 is released from the pushing force of the sliding portion 34*c*1, to return to the default position by the biasing force of the plate spring 77.

In the image forming apparatus 100, the attachment operation and the detachment operation of the toner container 32Y (excluding the opening/closing operation of a door 110) are each completed by one action of sliding the sliding portion 34*c*1 along the sliding surface 31*a*.

The toner container 32Y includes the cap portion 34Y with the toner discharge opening B directed downward in the vertical direction. The toner discharge opening B is provided at a lower position than the opening A in the vertical direction, and when the plug member 34*d* is surely positioned in synchronization with the attachment operation, the plug member 34*d* is pushed by the nozzle 70 to open the toner discharge opening B sealed by the packing 34*e*. Therefore, there is less toner stain in the toner discharge opening B, and it is prevented that a user's hand becomes stained with toner by touching the toner discharge opening B.

Because the attachment and the detachment operation of the toner container 32Y are each performed by one action of sliding the first sliding portion 34*c*1, the operability/workability upon replacement of the toner container 32Y is improved. Specifically, the first sliding portion 34*c*1 is provided on the bottom surface of the cap portion 34Y, and the first sliding portion 34*c*1 slides along the sliding surface 31*a* while supporting the toner container 32Y.

Furthermore, the attachment of toner container 32Y is performed by starting to slide the sliding portion 34*c*1 while a user directly grips the gripper 33*d*, then starting positioning of the cap portion 34Y in a state where the cap portion 34Y is biased by the arm pair, then starting insertion of the nozzle 70 into the hole of the holder 34*c*, and finishing the positioning of the cap portion 34Y, the insertion of the nozzle 70, and connecting to the drive unit as soon as the sliding is finished. Therefore, a user can have a feeling of a click when the cap portion 34Y is positioned at the same time when the sliding of the cap portion 34Y (attachment operation by one action) is progressed, and feels certain that no erroneous operation occurs in the attachment operation.

Furthermore, because the toner container 32Y is not set in the toner-container holding unit 31 (the image forming apparatus 100) from the upper side thereof, but is set from the front side of the toner-container holding unit 31 (the image forming apparatus 100), the flexibility of layout for the upper side of the toner-container holding unit 31 is enhanced. For example, even if a scanner (a document reader) is arranged just above the toner supplying unit 59, the operability/workability upon attachment/detachment of the toner container 32Y is not deteriorated. Furthermore, the flexibility of layout for a meshing position between the gear portion 33*c* and the drive gear 31*g* is also enhanced.

Because the toner container 32Y is installed in the image forming apparatus 100 with its longitudinal direction being horizontal, the toner capacity of the toner container 32Y can be increased without any effect on the layout in the height direction of the image forming apparatus 100, which reduces the frequency of replacement of the toner container 32Y.

According to the first embodiment, the toner container 32Y attached to the toner-container holding unit 31 is optimized in structure, and the gear portion 33*c* is detachably attached to the container body 33Y. Therefore, the operability/workability upon replacement of the toner container 32Y is improved, which leads to surely reducing the occurrence of toner stain. Moreover, the gear portion 33*c* does not wear out or break easily even if the toner container 32Y has a large capacity and contains a large amount of toner, which leads to improved recycling efficiency of the toner container 32Y.

Furthermore, according to the first embodiment, only the toner is contained in each of the toner containers 32Y, 32M, 32C, and 32K, however if the image forming apparatus appropriately supplies the two-component developer containing the toner and the carrier to each developing unit, the two-component developer can also be contained in each of the toner containers 32Y, 32M, 32C, and 32K. Even in such a case, the same effect as that of the first embodiment can be obtained.

Moreover, according to the first embodiment, the suction-type screw pump 60 for sending air to the inside of the tube 71 is provided in the toner supplying unit 59. Alternatively, a discharge-type screw pump for sending air to the inside of the tube 71 can be provided in the toner supplying unit 59. Still alternatively, a diaphragm-type air pump can be used as a pump connected to the tube 71. Even in such cases, the same effect as that of the first embodiment can be obtained.

Furthermore, according to the first embodiment, at least one of the image forming units 6Y, 6M, 6C, and 6K can be a process cartridge. Alternatively, the toner container can be provided integrally in a process cartridge. In other words, the toner container can be a part of the process cartridge. Even in such cases, the same effect as that of the first embodiment can be obtained.

Toner containers 32Y, 32M, 32C, and 32K according to a second embodiment of the present invention are explained referring to FIGS. 10 to 12 and 13A to 13D.

Figure 10:
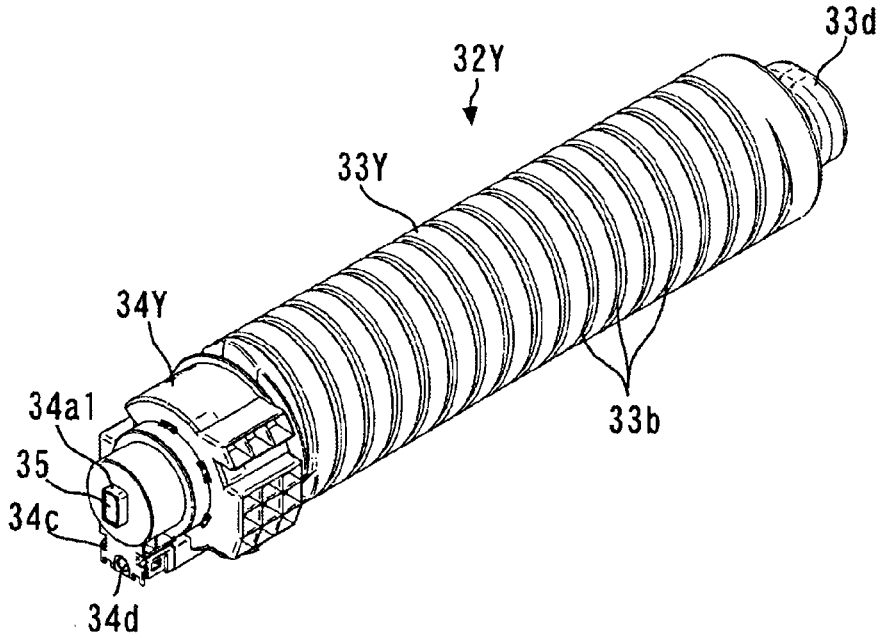
FIG. 10 is a perspective view of a toner container according to a second embodiment of the present invention.

FIG. 10 is a perspective view of the toner container 32Y according to the second embodiment of the present invention. In the same manner as the first embodiment, the toner container 32Y includes a container body 33Y and a cap portion 34Y, and a gear portion 33*c* is detachably attached to the container body 33Y.

The toner container 32Y is set to have a length of 500 mm or longer in the longitudinal direction. Specifically, the toner container 32Y has a length of 621 mm in the longitudinal direction and an outer diameter of 115 mm, and the diameter of an opening A formed in the toner container 32Y is 53.5 mm.

Although the toner container 32Y can contain more toner than that having a shorter length in the longitudinal direction, the load imposed on the gear portion 33*c* increases. However, in the same manner as the first embodiment, because the gear portion 33*c* is formed separately from the container body 33Y and is made of a material with mechanically sufficient strength, such a problem that the gear portion 33*c* wears greatly or breaks can be reduced.

Figure 11A:
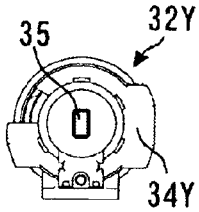
FIGS. 11A to 11G are schematic diagrams of the toner container as seen from various directions.
Figure 11B:
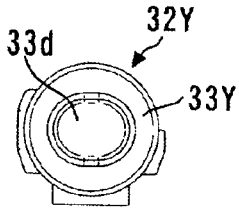
Figure 11C:
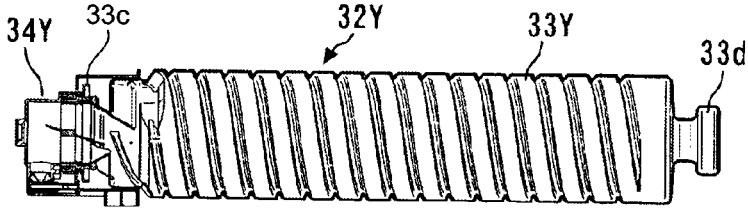
Figure 11D:
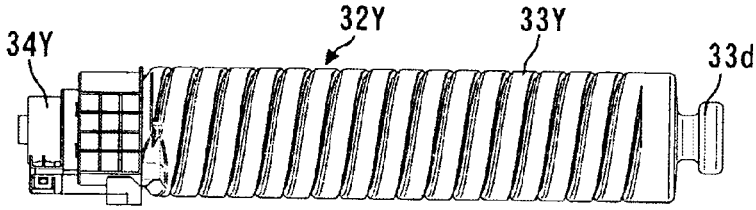
Figure 11E:
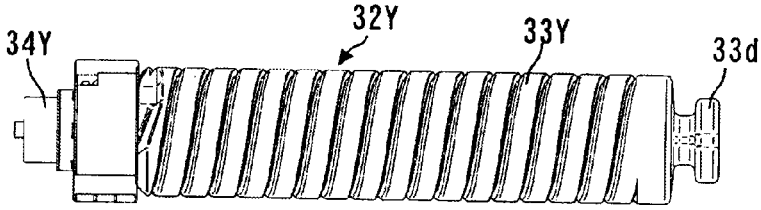
Figure 11F:
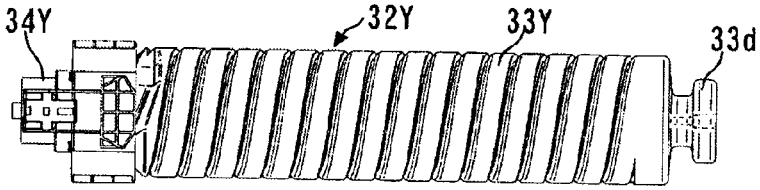
Figure 11G:
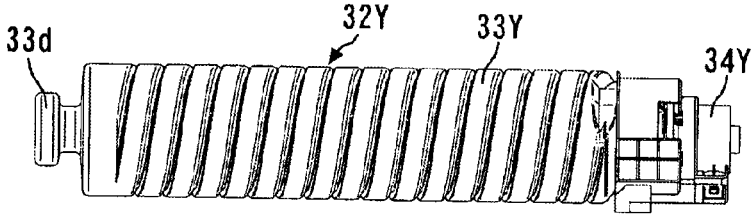

FIG. 11A is a front view of the toner container 32Y, FIG. 11B is a rear view of the toner container 32Y, FIG. 11C is a partially broken side view of the toner container 32Y, FIG. 11D is a right side view of the toner container 32Y, FIG. 11E is a top view of the toner container 32Y, FIG. 11F is a bottom view of the toner container 32Y, and FIG. 11G is a left side view of the toner container 32Y.

As shown in FIGS. 10 and 11A to 11G, the toner container 32Y does not include a protection cap 38 that covers an IC chip 35.

As shown in FIG. 11B, a gripper 33*d* includes a substantially oval head portion and a neck portion for hooking fingers. The neck portion has a diameter smaller than that of the head portion. Because the head portion has an oval shape, the gripper 33*d* easily fits a user's hand irrespective of the size of the user's hand. Thus, the workability of the attachment/detachment operation of the toner container 32Y is improved.

Because the gripper 33*d* and the container body 33Y are unified, and are made of a transparent resin material, the cost for manufacturing the toner container 32Y is reduced, and the color of the toner in the container body 33Y is easily recognized.

Figure 12:
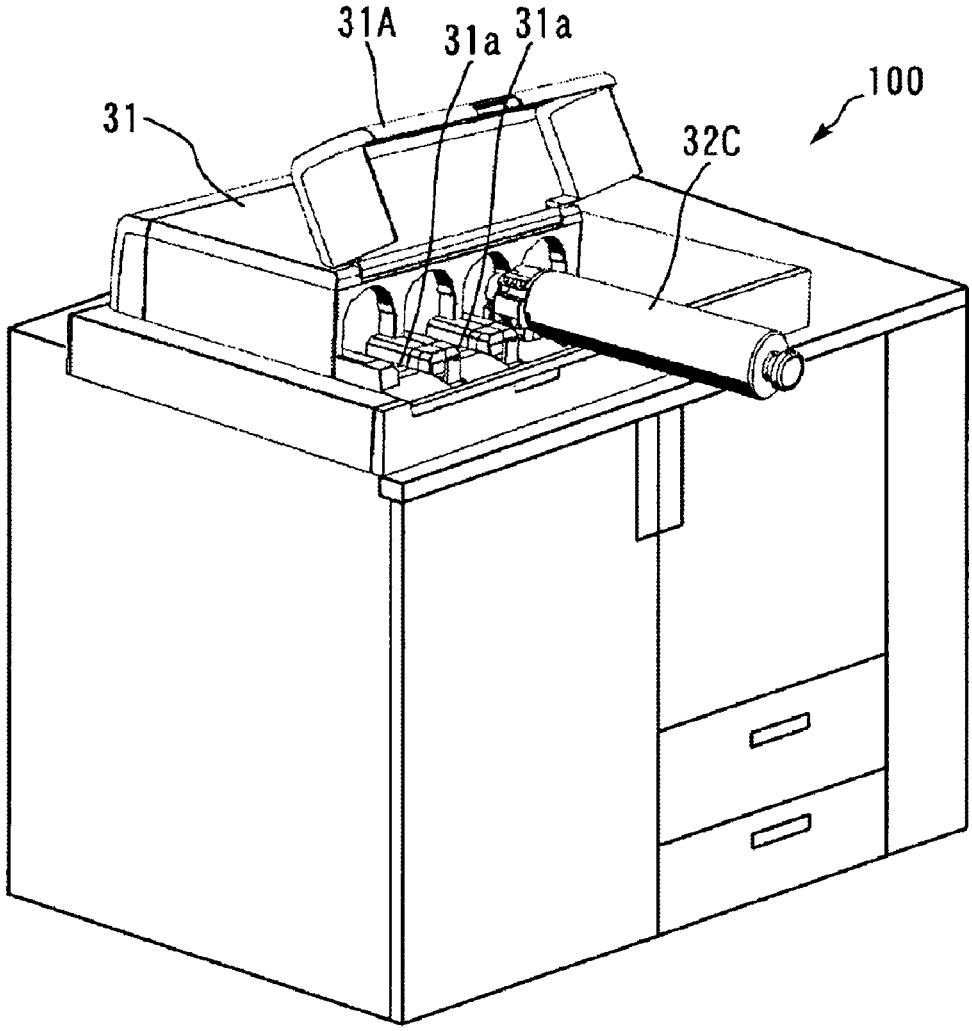
FIG. 12 is a perspective view of an image forming apparatus having another configuration.

FIG. 12 is a perspective view of an image forming apparatus 100 in which the toner containers 32Y, 32M, 32C, and 32K are provided.

As shown in FIG. 12, the image forming apparatus 100 is different from that in the first embodiment, and a toner-container holding unit 31 is provided in the uppermost portion of the image forming apparatus 100. For attaching/detaching the toner container, a cover 31A of the toner-container holding unit 31 is opened and closed.

Figure 13A:
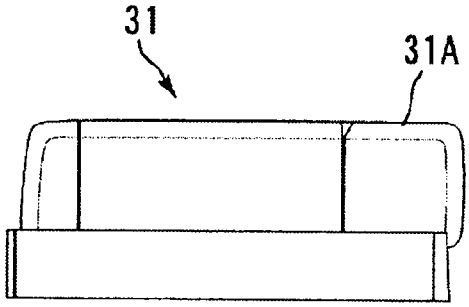
FIGS. 13A to 13D are schematic diagrams for explaining a process of attaching the toner container to a toner-container holding unit shown in FIG. 12.
Figure 13B:
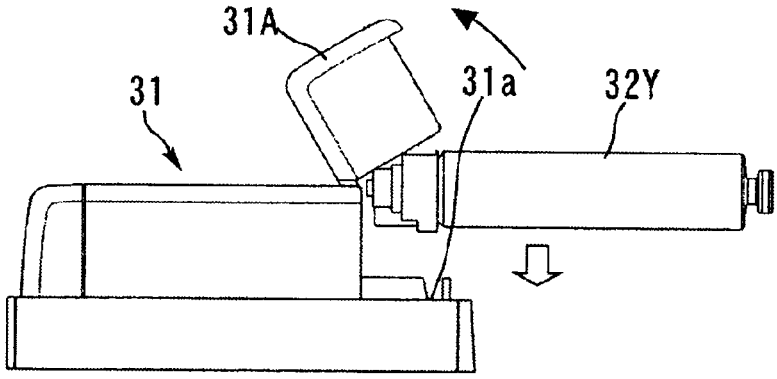

As shown in FIGS. 13A and 13B, when the toner container 32Y is attached to the toner-container holding unit 31 of the image forming apparatus 100 the cover 31A provided in the front side of the toner-container holding unit 31 is first opened to expose a sliding surface 31*a* of the toner-container holding unit 31.

Then, the toner container 32Y is moved in a direction indicated by a white arrow in FIG. 13B and is placed on the exposed sliding surface 31*a*. Because the cover 31A is opened, and a part of the sliding surface 31*a* is completely exposed, it becomes easy to set the toner container 32Y to the sliding surface 31*a*. In other words, the toner container 32Y can be attached to the toner-container holding unit 31 without looking into the position of the sliding surface 31*a*.

Figure 13C:
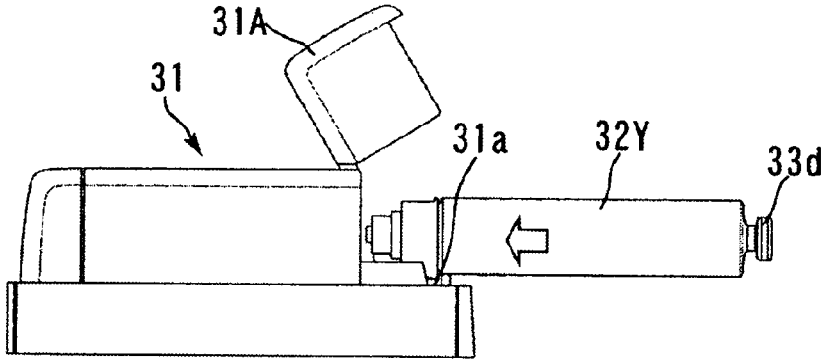

Then, as shown in FIG. 13C, the toner container 32Y is pushed into the toner-container holding unit 31 while sliding the toner container 32Y on the sliding surface 31*a* in a direction indicated by a white arrow. In other words, the toner container 32Y is pushed into the toner-container holding unit 31 from the cap portion 34Y along the longitudinal direction of the container body 33Y (the toner container 32Y).

Figure 13D:
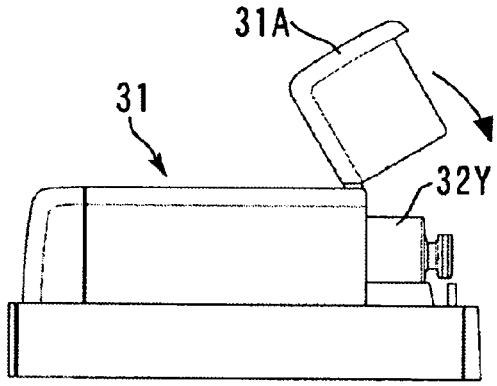

Then, as shown in FIG. 13D, the cover 31A is closed after the toner container 32Y is attached to a holding portion 73 of the toner-container holding unit 31 through the procedures same as those in the first embodiment.

According to the second embodiment, the toner container 32Y attached to the toner-container holding unit 31 is optimized in structure, and the gear portion 33*c* is detachably attached to the container body 33Y in the same manner as the first embodiment. Therefore, the operability/workability upon replacement of the toner container 32Y is improved, so that the occurrence of toner stain is reduced. Furthermore, even if the toner container 32Y has a large capacity and contains a large amount of toner, the gear portion 33*c* does not wear out or break easily, so that the recycling efficiency of the toner container 32Y is improved.

Toner containers 32Y, 32M, 32C, and 32K according to a third embodiment of the present invention are explained referring to FIGS. 14 to 23.

FIGS. 14, 16, 18, 20, and 22 are perspective views for explaining a process of attaching the toner container 32Y to a toner-container holding unit 31 (a holding portion 73) according to a third embodiment of the present invention. FIGS. 15, 17, 19, 21, and 23 are cross sections illustrating a portion of the toner container 32Y shown in FIGS. 14, 16, 18, 20, and 22, respectively.

Figure 14:
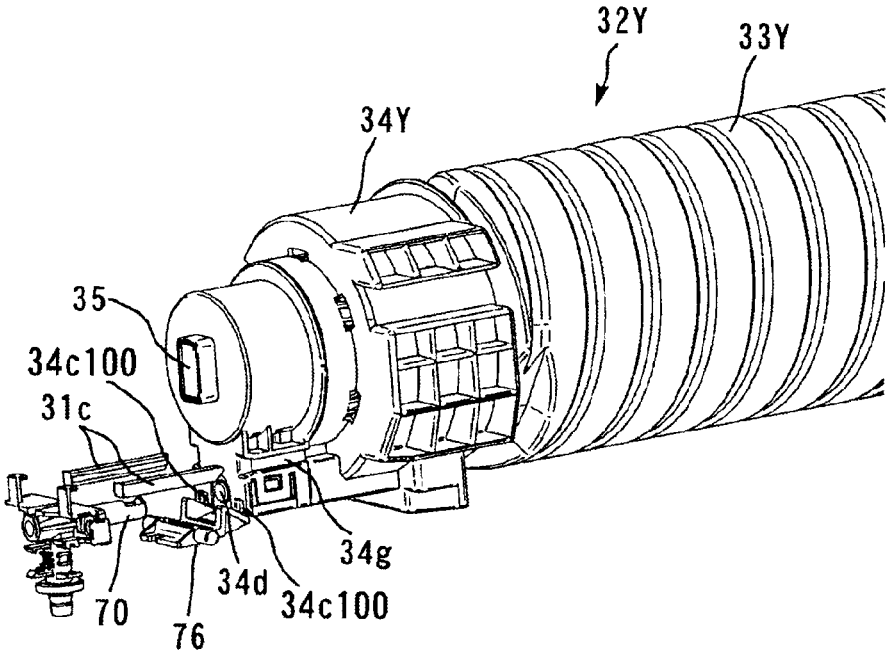
FIG. 14 is a perspective view for explaining a process of attaching a toner container to a toner-container holding unit according to a third embodiment of the present invention.
Figure 15:
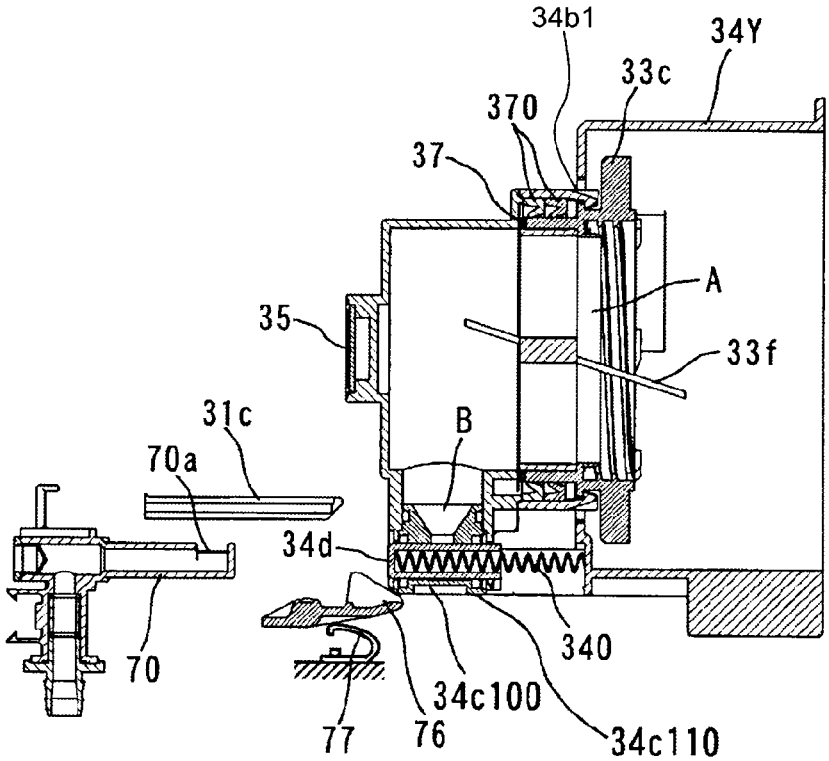
FIG. 15 is a cross section illustrating a portion of the toner container shown in FIG. 14.

In the same manner as the above embodiments, as shown in FIGS. 14 and 15, the toner container 32Y includes a container body 33Y and a cap portion 34Y, the cap portion 34Y includes a plug member (an opening/closing member) 34*d*, and a toner discharge opening B is formed in the cap portion 34Y. Thus, the toner container 32Y has less toner stain in the toner discharge opening B, so that it is prevented that a user's hand becomes stained with toner by touching the toner discharge opening B. Therefore, the operability/workability upon replacement of the toner container 32Y is improved.

The toner container 32Y has a length of about 621 mm in the longitudinal direction and an outer diameter of about 115 mm, and the diameter of an opening A formed in the toner container 32Y is 53.5 mm, in the same manner as that in the second embodiment.

As shown in FIG. 15, two of a packing 370, such as two G-seals, are arranged in a row between the container body 33Y and the cap portion 34Y around the opening A in the same manner as the second embodiment.

A tube shaped sealing member 37 made of an elastic material such as foamed polyurethane is provided in a clearance (about 1 mm) between the cap portion 34Y and the container body 33Y. Specifically, the sealing member 37 is adhered to the end surface of the cap portion 34Y opposing a tip end surface 33*a* around the opening A of the container body 33Y.

Provision of a sealing member on the circumferential surface of the container body 33Y (the cap portion 34Y) may generate a gap between the seal member and the container body 33Y with time, which may result in scattering toner. This is because the container body 33Y is driven to rotate in a state where the rotational center of the container body 33Y is decentered downward due to the weight of the toner, i.e., in a state where the sealing performance between the sealing member and the container body 33Y is reduced.

In this embodiment, however, because the sealing member 37 is provided to the end surface of the container body 33Y (the cap portion 34Y), even when the rotational center of the container body 33Y is decentered downward due to the weight of the toner, no gap is generated between the sealing member 37 and the container body 33Y (the cap portion 34Y).

In the same manner as the above embodiments, a gear portion 33*c* is not integrally formed with the container body 33Y, and is screwed into the container body 33Y as a separate member.

Specifically, as shown in FIG. 8, a thread groove 33*c*10 is formed on the inner circumferential surface of the gear portion 33*c*. A stirring member 33*f* is fitted into the inner circumferential surface of the gear portion 33*c*, and the thread groove 33*c*10 is screwed into a screw thread 33Y10 formed on the outer circumferential surface of the opening portion of the container body 33Y. At this time, when a projection 33*c*11 formed on the inner circumferential surface of the gear portion 33*c* slides over a projection 33Y11, the position of the gear portion 33*c* with respect to the container body 33Y is determined. With the provision of the projections 33*c*11 and 33Y11, the gear portion 33*c* attached to the container body 33Y is prevented from being detached from the container body 33Y.

Preferably, the direction in which the thread groove 33*c*10 is screwed into the screw thread 33Y10 matches the rotational direction of the container body 33Y. Thus, the rotational force is surely transmitted from the gear portion 33*c* to the container body 33Y, and it is prevented that when the container body 33Y is driven to rotate, the meshing of the screw thread 33Y10 and the thread groove 33*c*10 is loosened, and the gear portion 33*c* is detached from the container body 33Y.

Because the gear portion 33*c* and the container body 33Y can be separate members, the following requirements can be satisfied. That is, for example, to manufacture the gear portion 33*c* with higher precision than that of the container body 33Y, to recycle the container body 33Y by replacing only the gear portion 33*c*, which often wears out mechanically, and to manufacture the gear portion 33*c*, which often wears out mechanically, with a material having a mechanical strength higher than that of the container body 33Y.

As shown in FIGS. 14 and 15, the toner-container holding unit 31 (the holding portion 73) includes a nozzle 70, a claw member 76, a plate spring 77 as a second biasing member, and positioning members 31*c* in the same manner as that in the above embodiments.

A groove 34*c*100 and an erection portion 34*c*110 are provided on the lower side of the cap portion 34Y. The groove 34*c*100 is positioned to correspond to projections (claws) of the claw member 76, and is formed not to interfere with the movement of the claw member 76 upon the attachment/detachment operation of the toner container 32Y (or support the claw member 76 with an extremely small force). The claw member 76 moves along the groove 34*c*100 along with the attachment operation of the toner container 32Y, and comes into contact with the erection portion 34*c*110.

In synchronization with the attachment operation of the toner container 32Y, the claw member 76 relatively moves along the bottom (the groove 34*c*100) of the cap portion 34Y. Then, the claw member 76 is pushed by the erection portion 34*c*110 to retract to the position where the attachment of the cap portion 34Y is not obstructed, and moves to the position at which the claw member 76 is engaged with the plug member 34*d*. In synchronization with the detachment operation of the toner container 32Y, after biasing the plug member 34*d*, the claw member 76 is pushed by the erection portion 34*c*110 to retract to the position where the detachment of the cap portion 34Y is not obstructed. Then, the claw member 76 relatively moves along the bottom (the groove 34*c*100) of the cap portion 34Y.

Upon the attachment operation of the toner container 32Y to the toner-container holding unit 31, after the engagement of the cap portion 34Y and the positioning members 31*c* is started, the claw member 76 is pushed by the erection portion 34*c*110 to retract to the position where the attachment of the cap portion 34Y is not obstructed.

When the toner container 32Y is attached to the toner-container holding unit 31, a cover 31A (or a door 110 shown in FIG. 9) is first opened to expose the toner-container holding unit 31 to the front side.

Then, as shown in FIGS. 14 and 15, the toner container 32Y is pushed into the toner-container holding unit 31 from the cap portion 34Y side along the longitudinal direction of the container body 33Y (the toner container 32Y).

Figure 16:
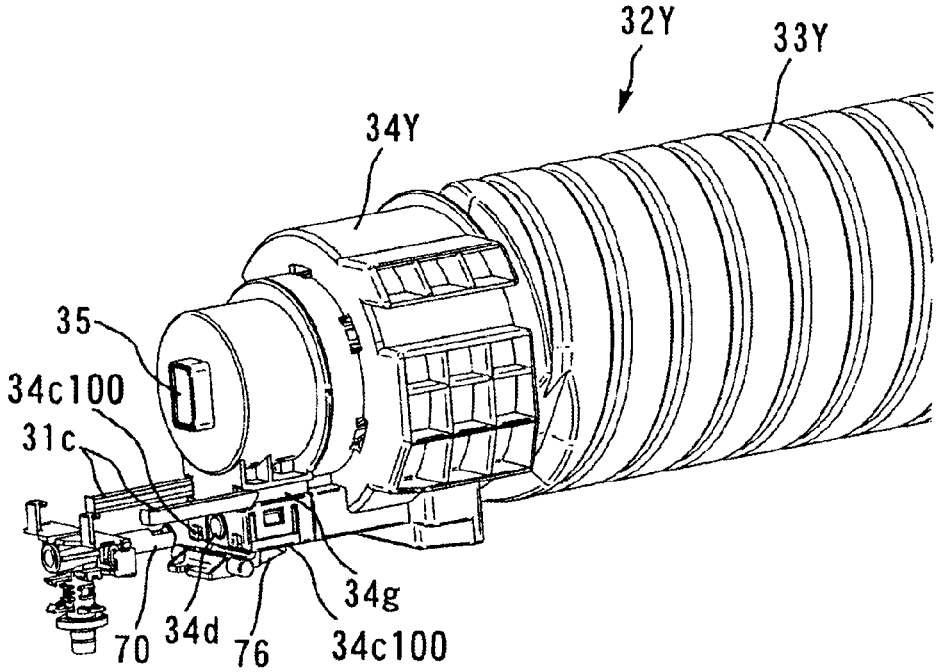
FIG. 16 is a perspective view for explaining a process of attaching the toner container to the toner-container holding unit after the process shown in FIG. 14.
Figure 17:
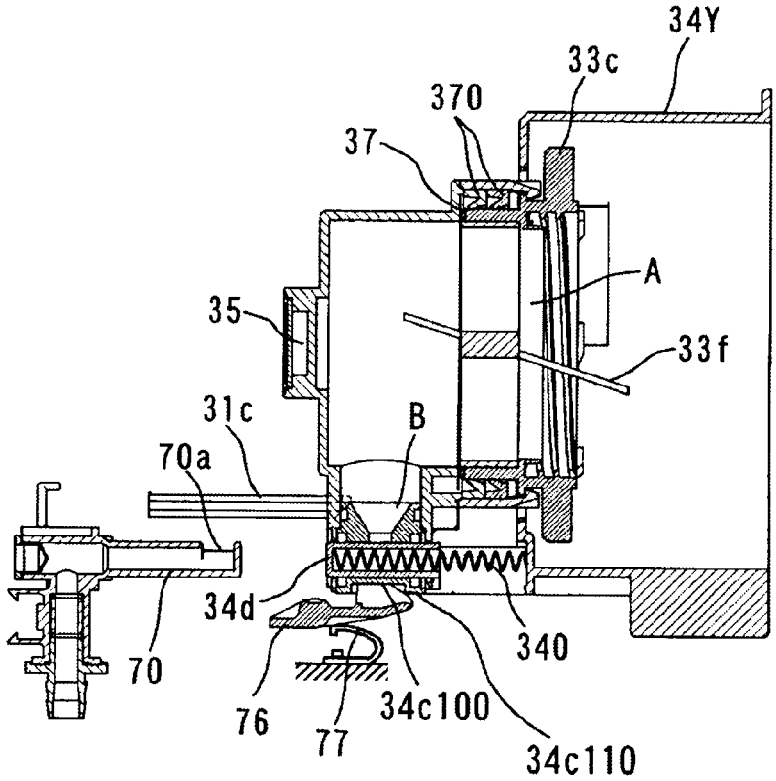
FIG. 17 is a cross section illustrating a portion of the toner container shown in FIG. 16.

Thereafter, when the cap portion 34Y reaches the holding portion 73, positioning of the cap portion 34Y is started by sliding a first sliding portion 34*c*1 along the sliding surface 31*a* and sliding a second sliding portion 34*c*2 along a sliding surface (a side surface) of the toner-container holding unit 31. Specifically, as shown in FIGS. 16 and 17, engaging portions 34*g* and the positioning members 31*c* start to be engaged with each other. During this time, the claw member 76 relatively moves along the bottom (the groove 34*c*100) without interfering with the movement of the cap portion 34Y (without changing the posture of the cap portion 34Y).

Thus, the engagement of the engaging portions 34*g* and the positioning members 31*c* is surely started without the cap portion 34Y being biased by the claw member 76. In other words, it is possible to prevent that the engaging portions 34*g* are pushed up by the biasing force by the claw member 76, and the engaging portions 34*g* and the positioning members 31*c* are not engaged with each other.

Figure 18:
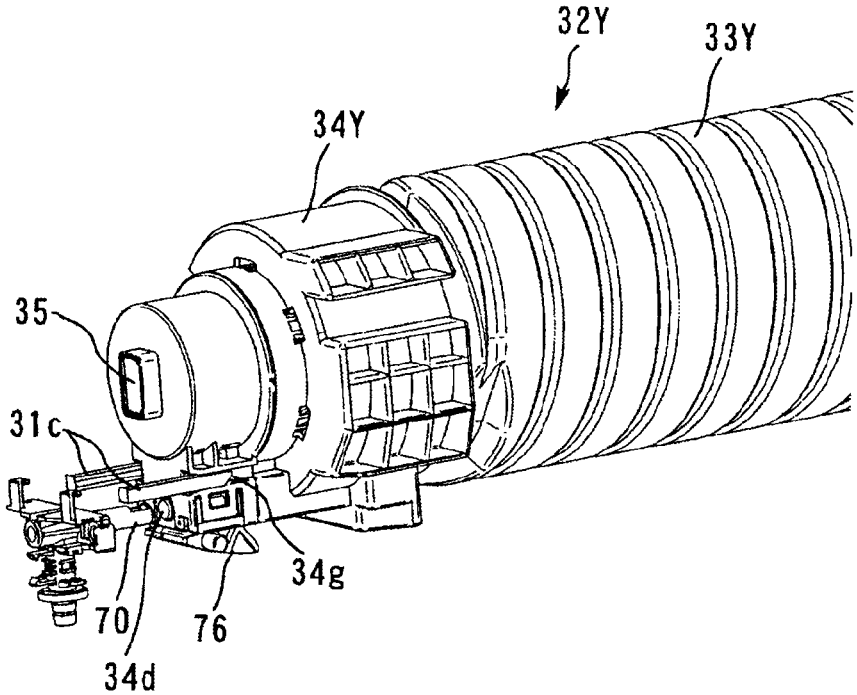
FIG. 18 is a perspective view for explaining a process of attaching the toner container to the toner-container holding unit after the process shown in FIG. 16.
Figure 19:
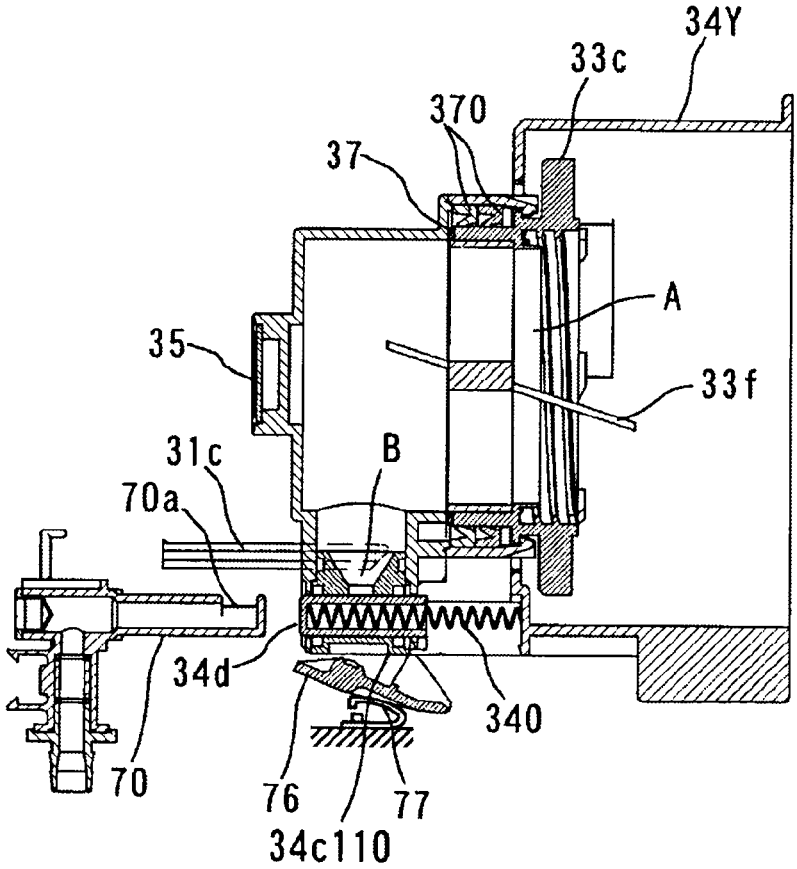
FIG. 19 is a cross section illustrating a portion of the toner container shown in FIG. 18.

Thereafter, when the attachment operation of the toner container 32Y is further progressed, as shown in FIGS. 18 and 19, the claw member 76 is pushed by the erection portion 34*c*110 and retracts to the position where the attachment of the cap portion 34Y is not obstructed while the engaging portions 34*g* are engaged with the positioning members 31*c*. That is, the claw member 76 rotates clockwise in FIG. 19 centering around the rotational axis. Specifically, the claw member 76 is pushed by the erection portion 34*c*110 to be pushed down in the direction that resists the biasing force of the plate spring 77.

Figure 20:
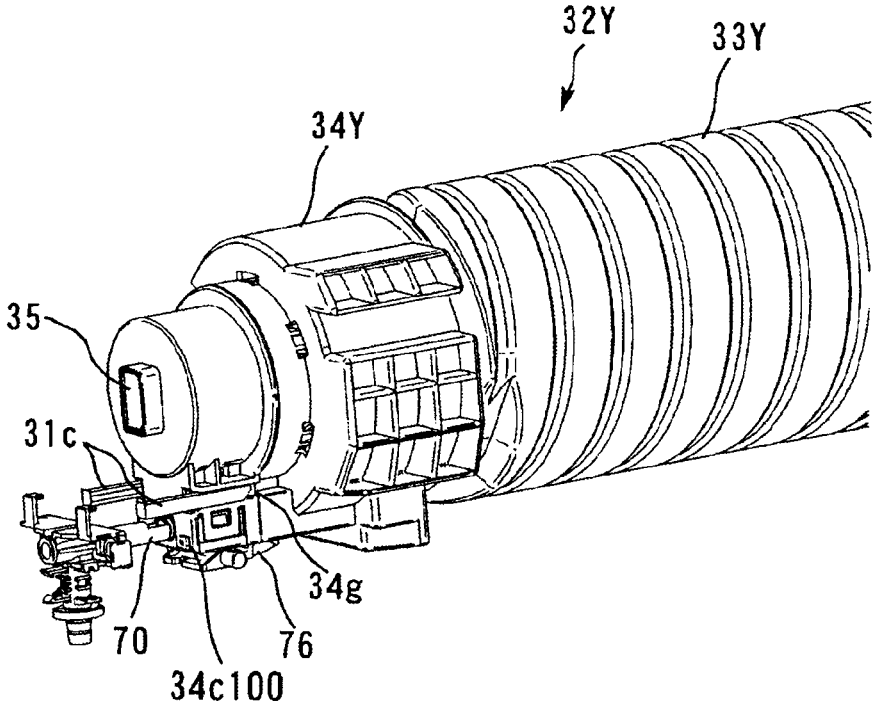
FIG. 20 is a perspective view for explaining a process of attaching the toner container to the toner-container holding unit after the process shown in FIG. 18.
Figure 21:
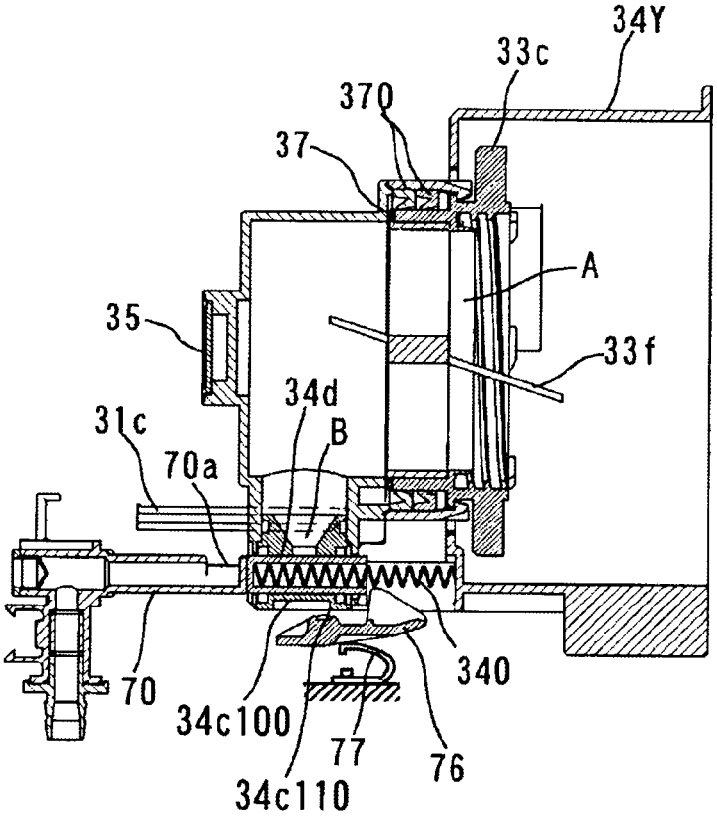
FIG. 21 is a cross section illustrating a portion of the toner container shown in FIG. 20.

Thereafter, when the attachment operation of the toner container 32Y is further progressed, as shown in FIGS. 20 and 21, the claw member 76 moves to the position where the claw member 76 is engaged with the plug member 34*d* while the engaging portions 34*g* are engaged with the positioning members 31*c*. That is, the claw member 76 rotates counterclockwise in FIG. 21 centering around the rotational axis. Specifically, the claw member 76 is released from the pushing force of the erection portion 34*c*110 and is pushed up to its default position by the biasing force of the plate spring 77.

In FIGS. 20 and 21, the plug member 34*d* is held by the nozzle 70 and the claw member 76, and the position of the plug member 34*d* is fixed in the toner-container holding unit 31.

When the toner container 32Y is further moved in the attachment direction (left side in FIG. 21) from the state shown in FIGS. 20 and 21, the toner discharge opening B is opened while the position of the plug member 34*d* is fixed. That is, the plug member 34*d* relatively moves. Specifically, while the engaging portions 34*g* are engaged with the positioning members 31*c*, the plug member 34*d* is pushed by the nozzle 70 in a direction that resists the biasing force by a compression spring 340 with the insertion of the front end of the nozzle 70 into a hole of the holder 34*c*.

Figure 22:
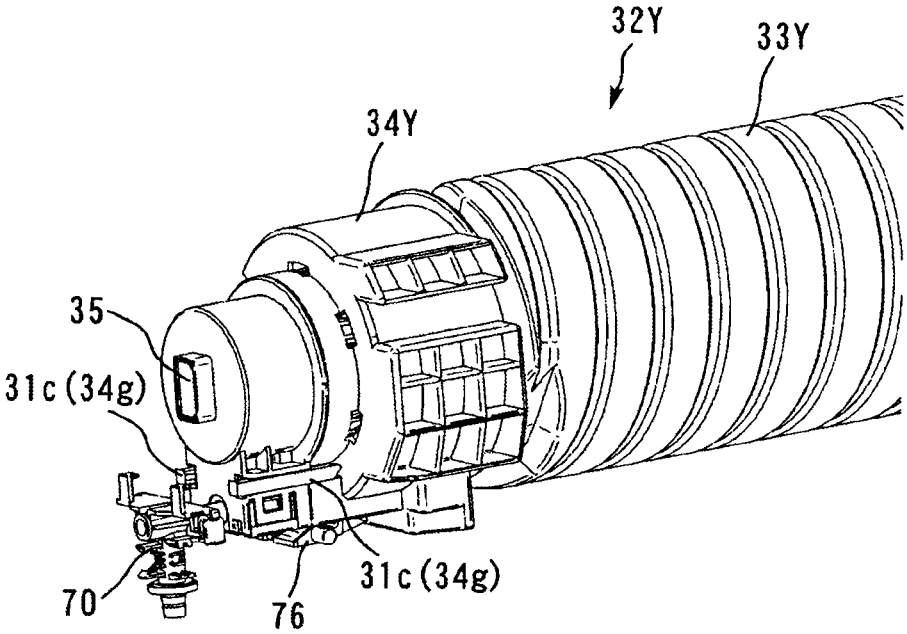
FIG. 22 is a perspective view for explaining a process of attaching the toner container to the toner-container holding unit after the process shown in FIG. 20.
Figure 23:
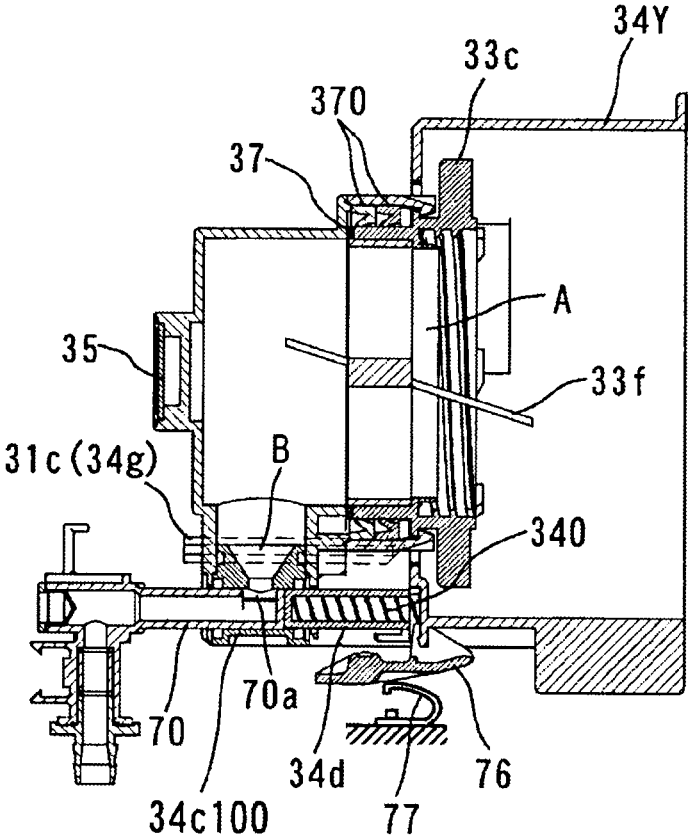
FIG. 23 is a cross section illustrating a portion of the toner container shown in FIG. 22.

As shown in FIGS. 22 and 23, the position of the cap portion 34Y is fixed at the position (contact reference position) where the holder 34*c* comes into contact with the holding portion 73, and at the same time, the plug member 34*d* fully opens the toner discharge opening B and the gear portion 33*c* meshes with a drive gear 31*g*. Therefore, the toner discharge opening B communicates with a toner supply opening 70*a* in the nozzle 70, and the attachment operation of the toner container 32Y is completed.

When the toner container 32Y is taken out (detached) from the toner-container holding unit 31, the operation is performed in the reverse manner of the attachment operation.

First, in synchronization with the separation operation (detachment operation) of the toner container 32Y from the toner-container holding unit 31, the plug member 34*d* is biased by the claw member 76 and the compression spring 340 while the position of the plug member 34*d* is fixed in the holding portion 73 by the nozzle 70 and the claw member 76, to close the toner discharge opening B. At this time, the end surface (right end surface in FIG. 21) of the plug member 34*d* is fitted into the fitting portion formed on the cap portion 34Y, and the toner discharge opening B is closed. Thereafter, when the toner container 32Y further moves in the separating direction, the claw member 76 moves to the position where the separation of the cap portion 34Y is not obstructed (see, FIGS. 18 and 19). Then, the claw member 76 is released from the pushing force of the erection portion 34*c*110, to return to the default position by the biasing force of the plate spring 77.

The attachment/detachment operation of the toner container 32Y in the third embodiment can of course be employed in the above embodiments.

According to the third embodiment, the toner container 32Y attached to the toner-container holding unit 31 is optimized in structure, and the gear portion 33*c* is detachably attached to the container body 33Y in the same manner as the above embodiments. Therefore, the operability/workability upon replacement of the toner container 32Y is improved, which leads to surely reducing the occurrence of toner stain. Moreover, the gear portion 33*c* does not wear out or break easily even if the toner container 32Y has a large capacity and contains a large amount of toner, which leads to improved recycling efficiency of the toner container 32Y.

The present invention is not limited to the above embodiments, and it will be apparent that the above embodiments can be appropriately changed other than those indicated in the embodiments, without departing from the technical spirit of the present invention. Furthermore, the number, the position, and the shape of the components are not limited to those shown in the embodiments, and any preferable number, position, and shape in implementing the present invention can be used.

According to the above embodiments, the toner container attached to the toner-container holding unit is optimized in structure, and the gear portion is detachably attached to the container body. Therefore, it is possible to provide a toner container, a process cartridge, and an image forming apparatus, in which the occurrence of toner stain is reduced because of improved operability/workability upon replacement, and recycling efficiency is high because the gear portion does not wear out or break easily even if the toner container has a large capacity and contains a large amount of toner.

Toner containers 32Y, 32M, 32C, and 32K according to a fourth embodiment of the present invention are explained referring to FIGS. 5 to 24.

Figure 24:
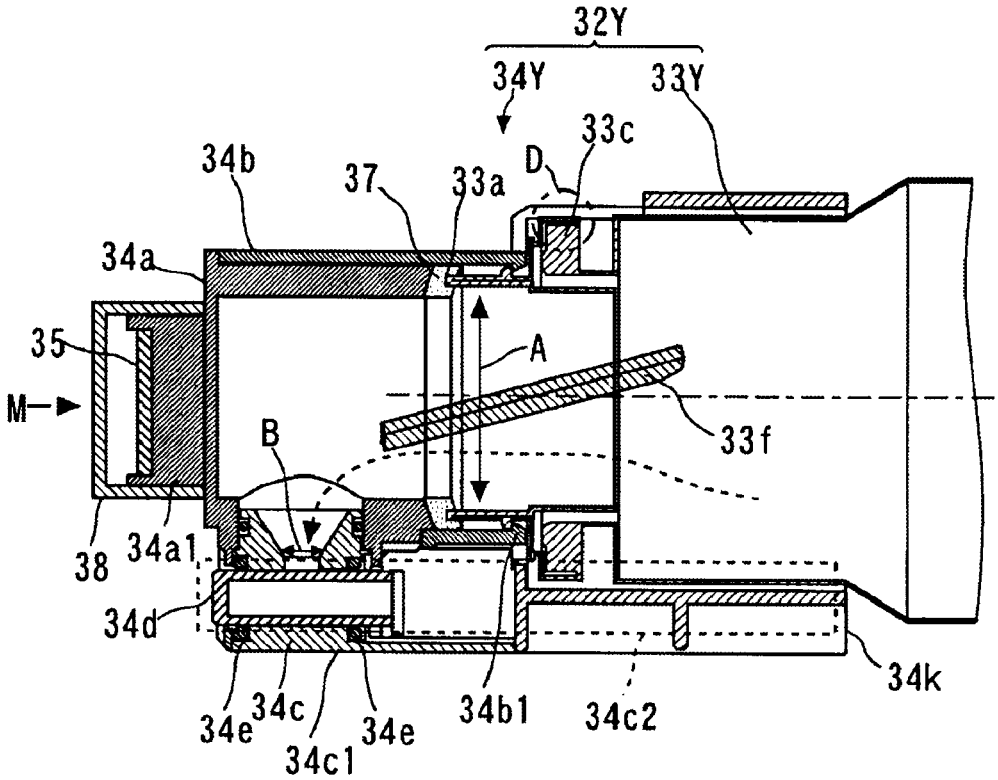
FIG. 24 is a cross section of a head portion of a toner container according to a fourth embodiment of the present invention.

FIG. 24 is a cross section of a head portion of the toner container 32Y according to the fourth embodiment of the present invention.

As shown in FIGS. 1, 4, and 9, the substantially cylindrical toner containers (toner bottles) 32Y, 32M, 32C, and 32K are detachably attached to a toner-container holding unit 31. Each of the toner containers 32Y, 32M, 32C, and 32K is replaced by a new one when all toner therein is consumed. The toners of different colors contained in the toner containers 32Y, 32M, 32C, and 32K are supplied into the developing units of the image forming units 6Y, 6M, 6C, and 6K through the toner supply paths explained in FIG. 3, respectively.

Each of the toner containers 32M, 32C, and 32K has the same configuration as the toner container 32Y except the positions of a recess 34*m* and a projection 34*n*. The toner container 32Y is explained below as a representative of the toner containers 32Y, 32M, 32C, and 32K.

As shown in FIG. 5, the toner container 32Y includes a container body 33Y and a cap portion (a bottle cap) 34Y attached to the head portion of the container body 33Y. A gear portion 33*c* is provided on the head portion of the container body 33Y, and an opening A is formed in the head portion of the container body 33Y (see, FIG. 24). The gear portion 33*c* rotates integrally with the container body 33Y. The toner contained in the container body 33Y is discharged toward the space in the cap portion 34Y through the opening A. When attaching the toner container 32Y to the toner-container holding unit 31, the toner container 32Y is inserted into the toner-container holding unit 31 from the head portion of the container body 33Y.

The gear portion 33*c* meshes with a drive gear 31*g* of a driving unit provided in the toner-container holding unit 31, so that the container body 33Y is rotated centering around a rotation axis indicated by a dashed line in FIG. 24. Specifically, a part of the gear portion 33*c* is exposed from a cutout 34*h* formed in the cap portion 34Y, and the gear portion 33*c* meshes with the drive gear 31*g* at a meshing position D shown in FIG. 24. Thus, the rotation force is transmitted from the drive gear 31*g* to the gear portion 33*c*, and the container body 33Y is rotated in a predetermined direction. In the fourth embodiment, the drive gear 31*g* and the gear portion 33*c* are both spur gears.

As shown in FIG. 5, the container body 33Y includes a gripper 33*d* on the rear portion thereof. A user grips the gripper 33*d* for the attachment/detachment operation of the toner container 32Y.

A spiral protrusion 33*b* is formed on the inner circumferential surface of the container body 33Y. In other words, a spiral groove is formed on the outer circumferential surface of the container body 33Y. When the container body 33Y is driven to rotate in the predetermined direction, the toner in the container body 33Y follows the spiral protrusion 33*b* and is discharged from the opening A. The container body 33Y can be manufactured by blow molding together with the gear portion 33*c* arranged on the circumferential surface of the container body 33Y.

A rod-like stirring member 33*f*, which rotates together with the container body 33Y, is provided at the opening A of the toner container 32Y. The stirring member 33*f* extends from the space in the cap portion 34Y toward the inside of the container body 33Y and inclines with respect to the rotation axis of the container body 33Y. Because the stirring member 33*f* rotates together with the container body 33Y, the efficiency of discharging the toner from the opening A is improved.

The container body 33Y is rotated counterclockwise as seen from the upstream side in the toner conveying direction, and the spiral of the spiral protrusion 33*b* is right-handed. This causes a spiral airflow spiraling in clockwise to be created in the toner container 32Y when the container body 33Y is rotated. The spiral airflow rotates in the same direction as the spiral airflow formed in a screw pump 60.

As shown in FIGS. 5 and 24, the cap portion 34Y includes a cap 34*a*, a cap cover 34*b*, a holder 34*c*, a plug member 34*d* (a shutter) that serves as an opening/closing member, a packing 34*e*, and an IC chip 35 as an electronic component. As shown in FIG. 5, engaging portions (grooves) 34*g*, with which positioning members 31*c* of the toner-container holding unit 31 are engaged, are provided on both sides of the cap portion 34Y. The recess 34*m*, into which a fitting member 31*d* of the toner-container holding unit 31 is fitted, is provided on the end surface of the cap portion 34Y. The projection 34*n*, which is fitted into a fitting member (not shown) of the toner-container holding unit 31, is provided on the circumferential surface of the cap portion 34Y. The cutout 34*h*, from which a part of the gear portion 33*c* is exposed, is provided in the upper side of the cap portion 34Y.

The cap portion 34Y is communicated with the inside of the container body 33Y through the opening A, and the toner discharged from the opening A is discharged from a toner discharge opening B formed in the cap portion 34Y (indicated by a dotted-line arrow in FIG. 24).

The cap portion 34Y has a substantially cylindrical space and a mortar shaped space. The mortar shaped space serves as a toner discharging path (vertical path) from the cylindrical space to the toner discharge opening B. With such a shape, a spiral airflow formed in the container body 33Y by the rotation of the container body 33Y is maintained, whereby the toner is efficiently conveyed toward the toner discharge opening B. Therefore, the toner discharged from the toner discharge opening B moves in a tube 71 more efficiently.

The cap portion 34Y is held by a holding portion 73 (see, FIG. 4) of the toner-container holding unit 31 in a state where the cap portion 34Y does not rotate together with the container body 33Y and the engaging portions 34*g* are engaged with the positioning members 31*c*.

The cap cover 34*b* is adhered to the circumferential surface of the cap 34*a*, and is provided with a claw 34*b*1 on the tip thereof. The claw 34*b*1 is engaged with an engaging member formed on the head portion of the container body 33Y, so that the container body 33Y is held by the cap portion 34Y to be relatively rotatable. The claw 34*b*1 and the engaging member are engaged with each other with an appropriate clearance therebetween so that the container body 33Y is driven to rotate smoothly.

A sealing member 37 is adhered to the surface of the cap portion 34Y opposing a tip end surface 33*a* around the opening A of the container body 33Y. The sealing member 37 is made of an elastic material such as foamed polyurethane, and seals the gap formed between the opposing surfaces of the container body 33Y and the cap portion 34Y around the opening A.

The holder 34*c* is provided on the lower side of the cap portion 34Y, and is provided with the plug member 34*d*. The plug member 34*d* is an opening/closing member for opening/closing the toner discharge opening B in synchronization with the attachment/detachment operation of the toner container 32Y. Specifically, the plug member 34*d* is provided in the holder 34*c* to be surrounded by first and second sliding portions 34*c*1 and 34*c*2 and to be movable in the right and left direction in FIG. 24. A space (recess) is formed on the bottom surface of the holder 34*c* for allowing a claw member 76 of an image forming apparatus 100 to be engaged with the plug member 34*d* and the plug member 34*d* to relatively move. The packing 34*e* such as G-seal is provided on both sides of the plug member 34*d* to prevent toner leakage from near the plug member 34*d*. Furthermore, a packing such as an O-ring is provided in the engaging portion 38*c* between the holder 34*c* and the cap 34*a*, to prevent toner leakage from a gap between the holder 34*c* and the cap 34*a*.

When the toner container 32Y is set to the toner-container holding unit 31, the claw member 76 (see, FIG. 5) is engaged with the right edge of the plug member 34*d*. The claw member 76 functions as a biasing member by receiving a biasing force from a plate spring 77 (a second biasing member) and biases the plug member 34*d* in the direction that closes the toner discharge opening B.

When the toner container 32Y is attached to the toner-container holding unit 31, the IC chip 35 is positioned to oppose a communication circuit 74 of the toner-container holding unit 31 with a predetermined distance therebetween. Specifically, the IC chip 35 is attached to a surface of a projection 34*a*1 of the cap portion 34Y that is substantially perpendicular to an attachment direction of the toner container 32Y to the toner-container holding unit 31. The IC chip 35 performs noncontact communication (wireless communication) with the communication circuit 74 in a state where the cap portion 34Y is held by the toner-container holding unit 31.

The IC chip 35 prestores various pieces of information related to the toner container 32Y and the toner contained in the toner container 32Y. The communication circuit 74 sends/receives the information to/from the IC chip 35 through wireless communication in a state where the toner container 32Y is set to the toner-container holding unit 31. Specifically, the information stored in the IC chip 35 is transmitted to a control unit 75 (see, FIG. 5) of the image forming apparatus 100 via the communication circuit 74, or the information of the image forming apparatus 100 obtained by the control unit 75 is transmitted to and stored in the IC chip 35.

The IC chip 35 stores information related to a toner such as a toner color, a serial number of a toner (production lot), and a date of toner production, and information related to recycling of a toner container such as the number of recycling, a date of recycling, and a recycling manufacturer. When the toner container 32Y is set to the toner-container holding unit 31, the information stored in the IC chip 35 is transmitted to the control unit 75 via the communication circuit 74. Thus, the image forming apparatus 100 is appropriately controlled based on the information received. For example, when the toner color is not the one that should be set in toner-container holding unit 31, a toner supplying unit 59 is stopped or the image forming condition is changed according to the serial number of the toner, or the recycling manufacturer.

The cap portion 34Y includes a protection cap 38 as a protection member that covers the entire surface of the IC chip 35 opposing the communication circuit 74. The protection cap 38 is made of resin, which has a sufficient strength and is thinned to the extent not to interfere with the communication between the IC chip 35 and the communication circuit 74. With such a configuration, even when a user carelessly causes the toner container 32Y to hit the image forming apparatus 100 during operation of replacing the toner container 32Y, the IC chip 35 is prevented from being damaged while maintaining the communication function of the IC chip 35.

The holder 34*c* includes the first sliding portion 34*c*1 and the second sliding portion 34*c*2. When the toner container 32Y is attached/detached to/from the toner-container holding unit 31, the first and second sliding portions 34*c*1 and 34*c*2 slide along the toner-container holding unit 31.

Specifically, the first sliding portion 34*c*1 is a flat portion formed to be parallel with a sliding surface 31*a* of the toner-container holding unit 31, and is provided on the bottom portion of the cap portion 34Y with which the attachment/detachment operation is performed. Furthermore, the second sliding portion 34*c*2 is a flat portion formed to be parallel with a sliding face (side surface) of the toner-container holding unit 31, and is provided on the side portion of the cap portion 34Y with which the attachment/detachment operation is performed.

As shown in FIG. 5, the recess 34*m* is formed near the projection 34*a*1 on the end surface of the cap portion 34Y. When the cap portion 34Y is properly attached to the toner-container holding unit 31, the fitting member 31*d* is fitted into the recess 34*m*.

Thus, it is prevented that a toner container for an inappropriate color (e.g., toner container for yellow) is set in a toner-container holding unit at the position for a predetermined color (e.g., toner container for cyan), and a desired color image cannot be formed.

As shown in FIG. 5, the projection 34*n*, which is fitted into a fitting member (not shown) of the toner-container holding unit 31, is provided on the circumferential surface of the cap portion 34Y. In the same manner as the recess 34*m*, when the cap portion 34Y is properly attached to the toner-container holding unit 31, the projection 34*n* is fitted into the fitting member. Although not shown, the projection 34*n* is positioned at a different position depending upon a toner container (container body) of each color.

Such a configuration prevents erroneous arrangement of the toner container in the toner-container holding unit in the same manner as the recess 34*m*.

The toner contained in the toner container 32Y and the attachment/detachment operation of the toner container 32Y to/from the toner-container holding unit 31 in the fourth embodiment are the same as those in the above embodiments.

In the image forming apparatus 100, the attachment operation and the detachment operation of the toner container 32Y (excluding the opening/closing operation of a door 110) are each completed by one action of sliding the first sliding portion 34*c*1 along the sliding surface 31*a*.

The toner container 32Y includes the cap portion 34Y with the toner discharge opening B directed downward in the vertical direction. The toner discharge opening B is provided at a lower position than the opening A in the vertical direction, and when the plug member 34*d* is surely positioned in synchronization with the attachment operation, the plug member 34*d* is pushed by a nozzle 70 to open the toner discharge opening B sealed by the packing 34*e*. Therefore, there is less toner stain in the toner discharge opening B, and it is prevented that a user's hand becomes stained with toner by touching the toner discharge opening B.

Because the attachment operation and the detachment operation of the toner container 32Y are each performed by one action of sliding the first sliding portion 34*c*1, the operability/workability upon replacement of the toner container 32Y is improved. Specifically, the first sliding portion 34*c*1 is provided on the bottom surface of the cap portion 34Y, and the first sliding portion 34*c*1 slides along the sliding surface 31*a* while supporting the toner container 32Y.

Furthermore, the attachment of toner container 32Y is performed by starting to slide the first sliding portion 34*c*1 while a user directly grips the gripper 33*d*, then starting positioning of the cap portion 34Y in a state where the cap portion 34Y is biased by the arm pairs, then starting insertion of the nozzle 70 into the hole of the holder 34*c*, and finishing the positioning of the cap portion 34Y, the insertion of the nozzle 70, and connecting to the drive unit as soon as the sliding is finished. Therefore, a user can have a feeling of a click when the cap portion 34Y is positioned at the same time when the sliding of the cap portion 34Y (attachment operation by one action) is progressed, and feels certain that no erroneous operation occurs in the attachment operation.

Furthermore, because the toner container 32Y is not set in the toner-container holding unit 31 (the image forming apparatus 100) from the upper side thereof, but is set from the front side of the toner-container holding unit 31 (the image forming apparatus 100), the flexibility of layout for the upper side of the toner-container holding unit 31 is enhanced. For example, even if a scanner (a document reader) is arranged just above the toner supplying unit 59, the operability/workability upon attachment/detachment of the toner container 32Y is not deteriorated. Furthermore, the flexibility of layout for the meshing position D between the gear portion 33*c* and the drive gear 31*g* is also enhanced.

Furthermore, because the toner container 32Y is installed in the image forming apparatus 100 with its longitudinal direction being horizontal, the toner capacity of the toner container 32Y can be increased without any effect on the layout in the height direction of the image forming apparatus 100, which reduces the frequency of replacement of the toner container 32Y.

According to the fourth embodiment, because the protection cap 38 is provided to cover the IC chip 35, the IC chip 35 is prevented from being damaged in advance.

Furthermore, according to the fourth embodiment, because the opening/closing of the toner discharge opening B by the plug member 34*d* is performed in synchronization with the attachment/detachment of the toner container 32Y to/from the toner-container holding unit 31 performed by one action, the opening/closing of the toner discharge opening B can be surely and smoothly performed. Therefore, the operability/workability upon replacement of the toner container 32Y is improved, and the occurrence of toner stain is surely reduced.

Moreover, according to the fourth embodiment, only the toner is contained in each of the toner containers 32Y, 32M, 32C, and 32K, however if the image forming apparatus appropriately supplies the two-component developer containing the toner and the carrier to each developing unit, the two-component developer can also be contained in each of the toner containers 32Y, 32M, 32C, and 32K. Even in such a case, the same effect as that of the first embodiment can be obtained.

Furthermore, according to the fourth embodiment, the spiral protrusion 33*b* is integrally formed with the container body 33Y on the inner circumferential surface thereof, and the container body 33Y is driven to rotate. Alternatively, a coil or a screw can be provided in the container body 33Y in a rotatable manner, and the coil or the screw can be driven to rotate without rotating the container body 33Y. In such a case, the same effect as that in the first embodiment can be obtained by providing the protection cap 38 that covers the IC chip 35 and opening/closing the toner discharge opening B by the plug member 34*d* in synchronization with the attachment/detachment of the toner container 32Y performed by one action.

Moreover, according to the fourth embodiment, a suction-type screw pump 60 for sending air to the inside of the tube 71 is provided in the toner supplying unit 59. Alternatively, a discharge-type screw pump for sending air to the inside of the tube 71 can be provided in the toner supplying unit 59. Still alternatively, a diaphragm-type air pump can be used as a pump connected to the tube 71. Even in such cases, the same effect as that of the fourth embodiment can be obtained by providing the protection cap 38 that covers the IC chip 35 and opening/closing the toner discharge opening B by the plug member 34*d* in synchronization with the attachment/detachment of the toner container 32Y performed by one action.

Furthermore, according to the fourth embodiment, at least one of the image forming units 6Y, 6M, 6C, and 6K can be a process cartridge. Alternatively, the toner container can be provided integrally to a process cartridge. In other words, the toner container can be a part of the process cartridge. Even in such cases, the same effect as that of the fourth embodiment can be obtained.

Toner containers 32Y, 32M, 32C, and 32K according to a fifth embodiment of the present invention are explained referring to FIGS. 6 to 8, 11B, 25, 26, and 27A to 27E.

Figure 25:
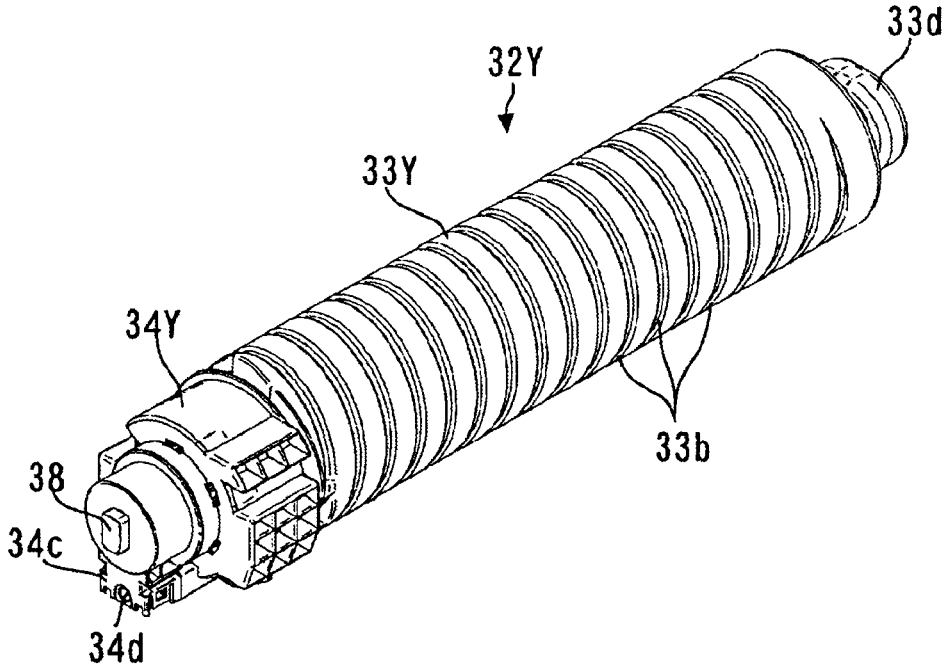
FIG. 25 is a perspective view of a toner container according to a fifth embodiment of the present invention.

FIG. 25 is a perspective view of the toner container 32Y according to the fifth embodiment of the present invention. The toner container 32Y according to the fifth embodiment is different from the toner container 32Y according to the fourth embodiment in the following point. That is, a biasing member that biases a plug member 34*d* is provided to the toner container 32Y.

The toner container 32Y includes a container body 33Y and a cap portion 34Y in the same manner as the fourth embodiment. The toner container 32Y has a length of 500 mm or longer in the longitudinal direction. Specifically, the toner container 32Y has a length of 621 mm in the longitudinal direction and an outer diameter of 115 mm, and the diameter of an opening A formed in the toner container 32Y is 53.5 mm.

The toner container 32Y has a possibility to hit the image forming apparatus upon replacement due to carelessness of a user more than a case of a toner container with shorter length. However, because a protection cap 38 (a protection member) is provided to cover an IC chip 35 (an electronic component) in the same manner as the fourth embodiment, the IC chip 35 is prevented from being damaged in advance.

FIG. 25 depicts the toner container 32Y with the protection cap 38 attached, and FIGS. 11A to 11G depict the toner container 32Y with the protection cap 38 removed.

FIG. 6 is a cross section of a head portion of the toner container 32Y, FIG. 7 is an exploded perspective view of the cap portion 34Y, and FIG. 8 is an exploded perspective view of the container body 33Y.

As shown in FIGS. 6 and 7, a compression spring 340 that biases a plug member 34*d* (a shutter) as an opening/closing member in a closing direction (direction that closes a toner discharge opening) is provided not to a toner-container holding unit 31 but to the toner container 32Y.

Specifically, a holder 34*c* is detachably attached to the cap portion 34Y, and includes a holder main part 34*c*10, a holder cover 341, the plug member 34*d*, and the compression spring 340 that functions as a biasing member. The toner discharge opening and a through hole communicating with the toner discharge opening are formed in the holder main part 34*c*10. The plug member 34*d* is inserted into one end of the through hole (a nozzle 70 is inserted into the other end of the through hole). Furthermore, the compression spring 340 is attached from the rear side of the plug member 34*d*. In such a state, the holder main part 34*c*10, the plug member 34*d*, and the compression spring 340 are held onto the cap portion 34Y by the holder cover 341. Because the holder main part 34*c*10 is held on the cap portion 34Y via an O-ring 342, the toner is prevented from scattering from the outer circumferential surface of the holder main part 34*c*10. As shown in FIG. 6, because a blind hole that guides a part of the compression spring 340 is formed in the plug member 34*d*, buckling of the compression spring 340 is suppressed.

Because the compression spring 340, which biases the plug member 34*d* in the direction that closes the toner discharge opening, is provided to the toner container 32Y, even the toner container 32Y alone can surely close the toner discharge opening by the plug member 34*d*, whereby the toner is surely prevented from scattering.

As shown in FIG. 6, for sealing the gap formed between the opposing surfaces of the container body 33Y and the cap portion 34Y around the opening A, two of a packing 370, such as G-seals, are provided in a row instead of the sealing member 37 such as foamed polyurethane in the fourth embodiment. Even if the container body 33Y is eccentrically attached to the cap portion 34Y or the container body 33Y is driven to rotate eccentrically with respect to the cap portion 34Y, lip portions (rubber portions) of the packings 370 follow the movement of the container body 33Y and wear little over time. Thus, the sealing properties between the container body 33Y and the cap portion 34Y are stably improved. Particularly, because a plurality of the packings 370 are provided, the improvement of the sealing properties is remarkable.

As shown in FIG. 6, the packings 370 are arranged so that a tip of a lip portion of each packing 370, which makes contact with the periphery of the container body 33Y, is inclined in such a manner that an inner diameter of the lip portion becomes smaller toward the opening A of the container body 33Y (right side in FIG. 6). In other words, the tip of the lip portion is inclined toward the side on which the toner is contained (the side opposite to the side on which the toner should not be scattered). Thus, the sealing properties between the container body 33Y and the cap portion 34Y by the packings 370 are improved.

The packings 370 are arranged so that tips of the lip portions are inclined in the same direction. Therefore, when the cap portion 34Y is attached to the container body 33Y, the lip portion does not roll up easily.

As shown in FIGS. 6 and 8, a gear portion 33*c* is not integrally formed with the container body 33Y, and is screwed into the container body 33Y as a separate member.

Specifically, as shown in FIG. 8, a thread groove 33*c*10 is formed on the inner circumferential surface of the gear portion 33*c*. A stirring member 33*f* is fitted into the inner circumferential surface of the gear portion 33*c*, and the thread groove 33*c*10 is screwed into a screw thread 33Y10 formed on the outer circumferential surface of the opening portion of the container body 33Y. At this time, when a projection 33*c*11 formed on the inner circumferential surface of the gear portion 33*c* slides over a projection 33Y11 formed on the container body 33Y, the position of the gear portion 33*c* with respect to the container body 33Y is determined. With the provision of the projections 33*c*11 and 33Y11, the gear portion 33*c* attached to the container body 33Y is prevented from being detached from the container body 33Y.

Preferably, the direction in which the thread groove 33*c*10 is screwed into the screw thread 33Y10 matches the rotational direction of the container body 33Y. Thus, the rotational force is surely transmitted from the gear portion 33*c* to the container body 33Y, and it is prevented that when the container body 33Y is driven to rotate, the meshing of the screw thread 33Y10 and the thread groove 33*c*10 is loosened, and the gear portion 33*c* is detached from the container body 33Y.

Because the gear portion 33*c* and the container body 33Y are separate members, the following requirements can be satisfied. That is, for example, to manufacture the gear portion 33*c* with higher precision than that of the container body 33Y, to recycle the container body 33Y by replacing only the gear portion 33*c*, which often wears out mechanically, and to manufacture the gear portion 33*c*, which often wears out mechanically, with a material having a mechanical strength higher than that of the container body 33Y.

Figure 26:
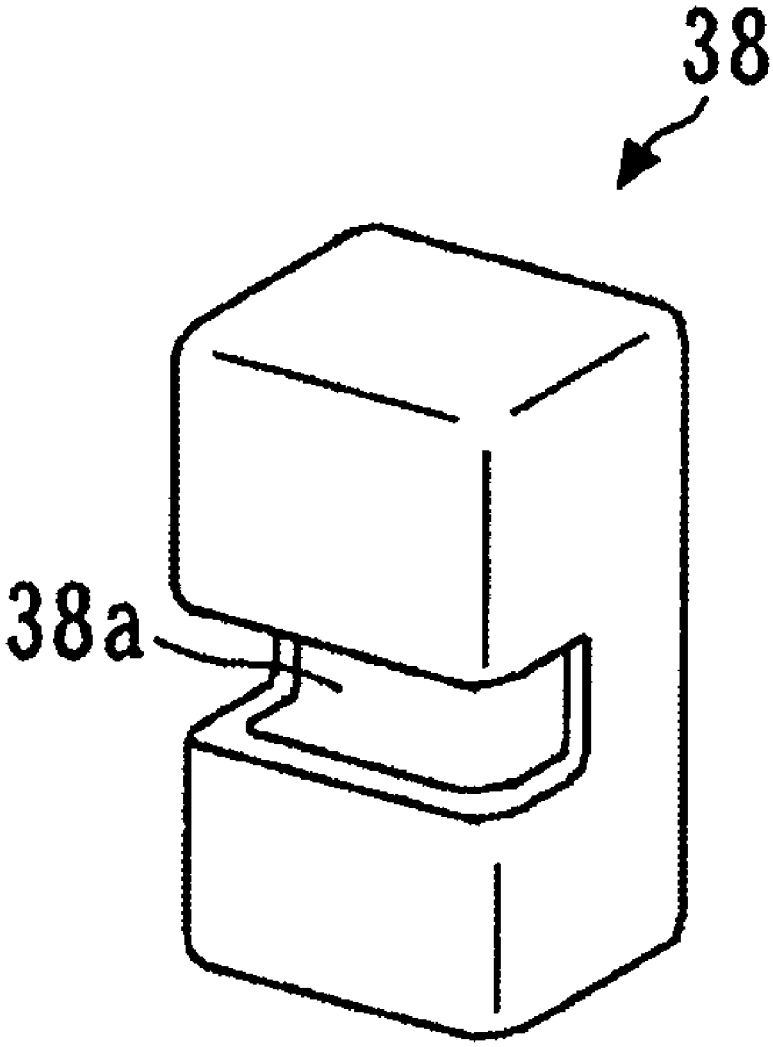
FIG. 26 is a perspective view of a protection member that is different from a protection member attached to the toner container shown in FIG. 25.
Figure 27A:
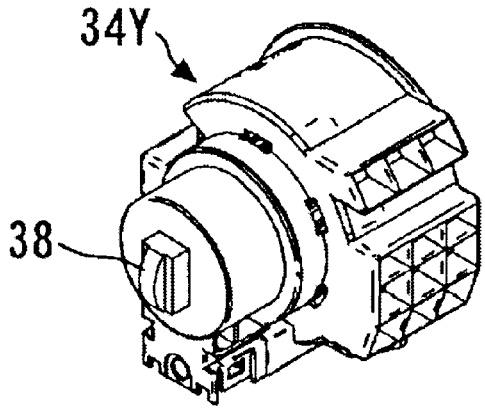
FIGS. 27A to 27E are perspective views each representing a state where a protection member having still another structure is attached to a cap portion shown in FIG. 25.
Figure 27B:
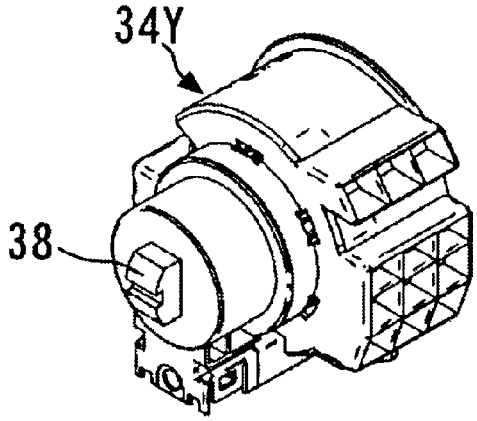
Figure 27C:
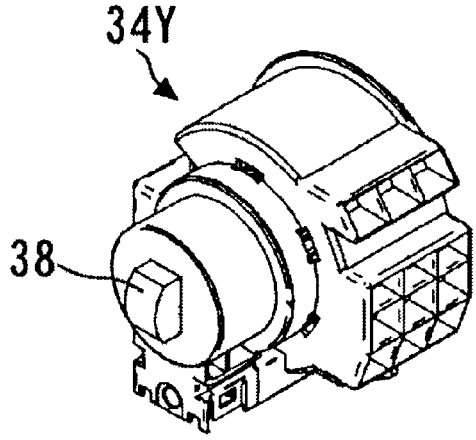
Figure 27D:
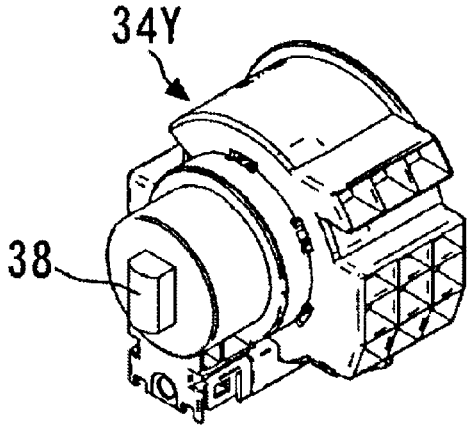
Figure 27E:
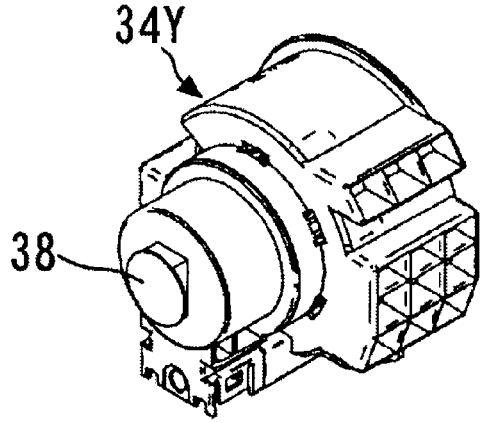

The protection cap 38 is provided to cover entire surface of the IC chip 35 opposing a communication circuit 74. Alternatively, as shown in FIG. 26, the protection cap 38 can be configured to cover a part of the opposing surface of the IC chip 35. Specifically, a slit can be formed in the surface of the protection cap 38 opposing the IC chip 35, whereby communication failure between the protection cap 38 and the IC chip 35 can be surely suppressed.

Furthermore, the shape of the protection cap 38 is not limited to the shape in the fifth embodiment, and can be formed into any other shape such as those shown in FIGS. 27A to 27E.

As shown in FIG. 11B, a gripper 33*d* includes a substantially oval head portion and a neck portion for hooking fingers. The neck portion has a diameter smaller than that of the head portion. Because the head portion has an oval shape, the gripper 33*d* easily fits a user's hand irrespective of the size of the user's hand. Thus, the workability of the attachment/detachment operation of the toner container 32Y is improved.

Because the gripper 33*d* and the container body 33Y are unified, and are made of a transparent resin material, the cost for manufacturing the toner container 32Y is reduced, and the color of the toner in the container body 33Y is easily recognized.

An image forming apparatus 100 in which the toner containers 32Y, 32M, 32C, and 32K according to the fifth embodiment are provided is as illustrated in FIG. 12 as a perspective view. In the fifth embodiment, the attachment/detachment operation of the toner container 32Y is the same as that explained by referring to FIGS. 12 and 13A to 13D.

According to the fifth embodiment, the toner container 32Y attached to the toner-container holding unit 31 is optimized in structure, and the protection cap 38 that covers the IC chip 35 is provided in the same manner as the fourth embodiment. Therefore, the operability/workability upon replacement of the toner container 32Y is improved, which leads to surely reducing the occurrence of toner stain, and prevents the IC chip 35 from being damaged in advance.

Particularly, when the toner container 32Y with a large capacity is attached to the image forming apparatus 100 as in the fifth embodiment, although the toner-container holding unit 31 is arranged in the top portion of the image forming apparatus 100, a user needs to hold the toner container 32Y with both hands upon attachment of the toner container 32Y. Thus, the IC chip 35 may hit the image forming apparatus 100 and be damaged. Therefore, the provision of the protection cap 38 is extremely effective.

Toner containers 32Y, 32M, 32C, and 32K according to a sixth embodiment of the present invention are explained referring to FIGS. 28 and 29A to 29C.

Figure 28:
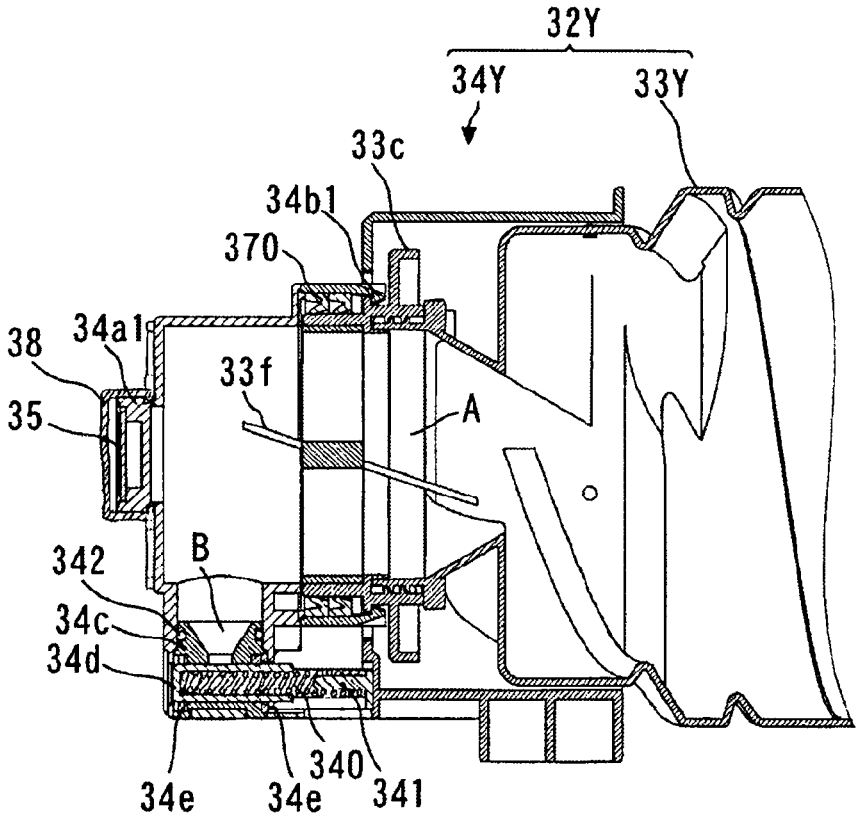
FIG. 28 is a cross section of a head portion of a toner container according to a sixth embodiment of the present invention.
Figure 29A:
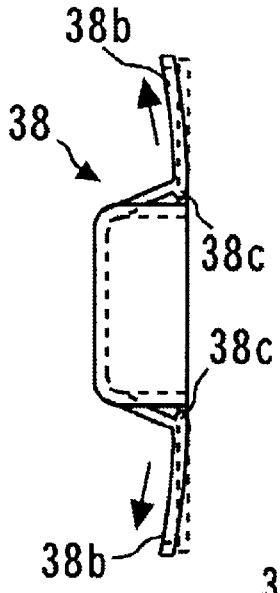
FIGS. 29A to 29C are schematic diagrams illustrating a protection member detachably attached to the toner container shown in FIG. 28.
Figure 29B:
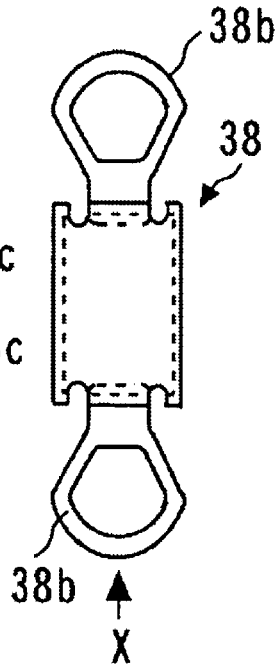
Figure 29C:
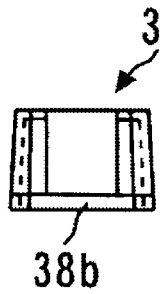

FIG. 28 is a perspective view of a head portion of the toner container 32Y according to the sixth embodiment of the present invention, FIG. 29A is a side view of a protection cap 38 (protection member), FIG. 29B is a top view of the protection cap 38, and FIG. 29C is a schematic view of the protection cap 38 as seen from the X direction in FIG. 29B.

The toner container 32Y according to the sixth embodiment is different from the toner container 32Y according to the fifth embodiment in the following point. That is, the protection cap 38 is detachable.

The toner container 32Y includes a container body 33Y and a cap portion 34Y in the same manner as that in the fifth embodiment, and the cap portion 34Y includes the protection cap 38 that covers an IC chip 35 (an electronic component) in the same manner as the fourth embodiment. The IC chip 35 is fixed on a projection 34*a*1 of the cap portion 34Y.

The protection cap 38 is detachably attached to the cap portion 34Y. Specifically, as shown in FIGS. 29A to 29C, the protection cap 38 includes hook portions 38*b* at both ends. The hook portion 38*b* has a hole that fits the size of a user's finger, and is bent by hand in a direction indicated by an arrow in FIG. 29A. An engaging portion 38*c* is formed at the root of each hook portion 38*b*. The engaging portions 38*c* engage with a recess formed on the cap portion 34Y. With such a structure, the protection cap 38 can be detached from the cap portion 34Y by gripping and bending the hook portions 38*b*. Therefore, the IC chip 35 can be replaced easily.

According to the sixth embodiment, the toner container 32Y attached to a toner-container holding unit 31 is optimized in structure, and the protection cap 38 that covers the IC chip 35 is provided in the same manner as the above embodiments. Therefore, the operability/workability upon replacement of the toner container 32Y is improved, which leads to surely reducing the occurrence of toner stain, and prevents the IC chip 35 from being damaged in advance.

Toner containers 32Y, 32M, 32C, and 32K according to a seventh embodiment of the present invention are explained referring to FIGS. 30 and 31A to 31C.

Figure 30:
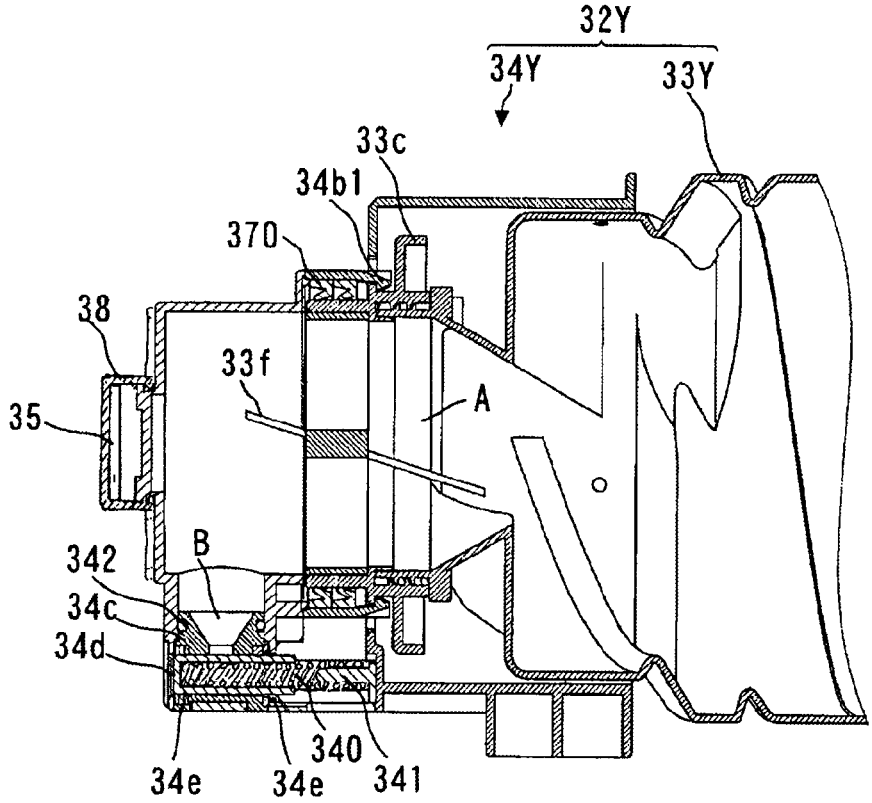
FIG. 30 is a cross section of a head portion of a toner container according to a seventh embodiment of the present invention.
Figures 31A, 31B:
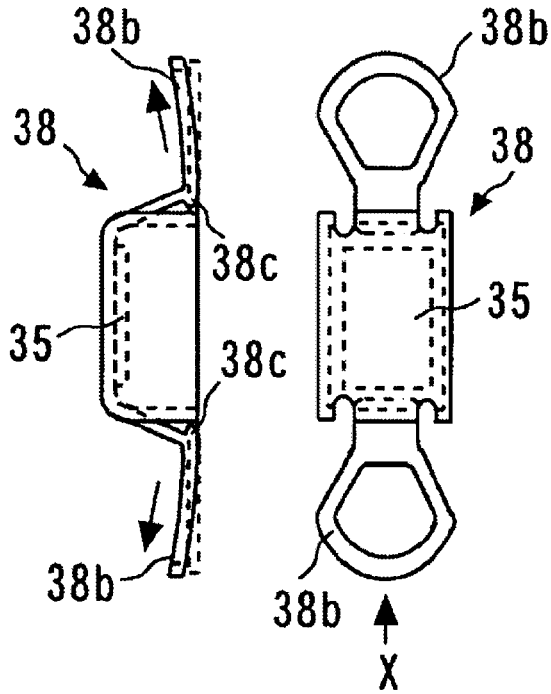
FIGS. 31A to 31C are schematic diagrams of a protection member detachably attached to the toner container shown in FIG. 30.
Figure 31C:
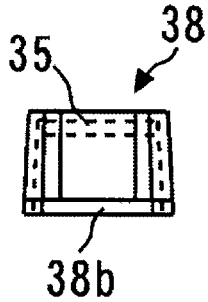

FIG. 30 is a perspective view of a head portion of the toner container 32Y according to the seventh embodiment of the present invention, FIG. 31A is a side view of a protection cap 38 (protection member), FIG. 31B is a top view of the protection cap 38, and FIG. 31C is a schematic view of the protection cap 38 as seen from the X direction in FIG. 31B.

The toner container 32Y according to the seventh embodiment is different from the toner container 32Y according to the sixth embodiment in the following point. That is, an IC chip 35 is integrally provided on the protection cap 38.

The toner container 32Y includes a container body 33Y and a cap portion 34Y in the same manner as that in the sixth embodiment, and the cap portion 34Y is provided with the protection cap 38, which covers the IC chip 35 (an electronic component) and is detachable, in the same manner as the third embodiment.

The IC chip 35 is integrally provided on the protection cap 38. Specifically, as shown in FIGS. 30, and 31A to 31C, the IC chip 35 is fixed on the inner surface of the protection cap 38 with a double-sided tape or the like. Thus, the IC chip 35 can be replaced easily, for example, for upgrading the IC chip 35 in the case of recycling the toner container 32Y.

According to the seventh embodiment, the toner container 32Y attached to a toner-container holding unit 31 is optimized in structure, and the protection cap 38 that covers the IC chip 35 is provided in the same manner as the above embodiments. Therefore, the operability/workability upon replacement of the toner container 32Y is improved, which leads to surely reducing the occurrence of toner stain, and prevents the IC chip 35 from being damaged in advance.

Toner containers 32Y, 32M, 32C, and 32K according to an eighth embodiment of the present invention are explained referring to FIGS. 14, 16 to 23, 32A, and 32B.

Figure 32A:
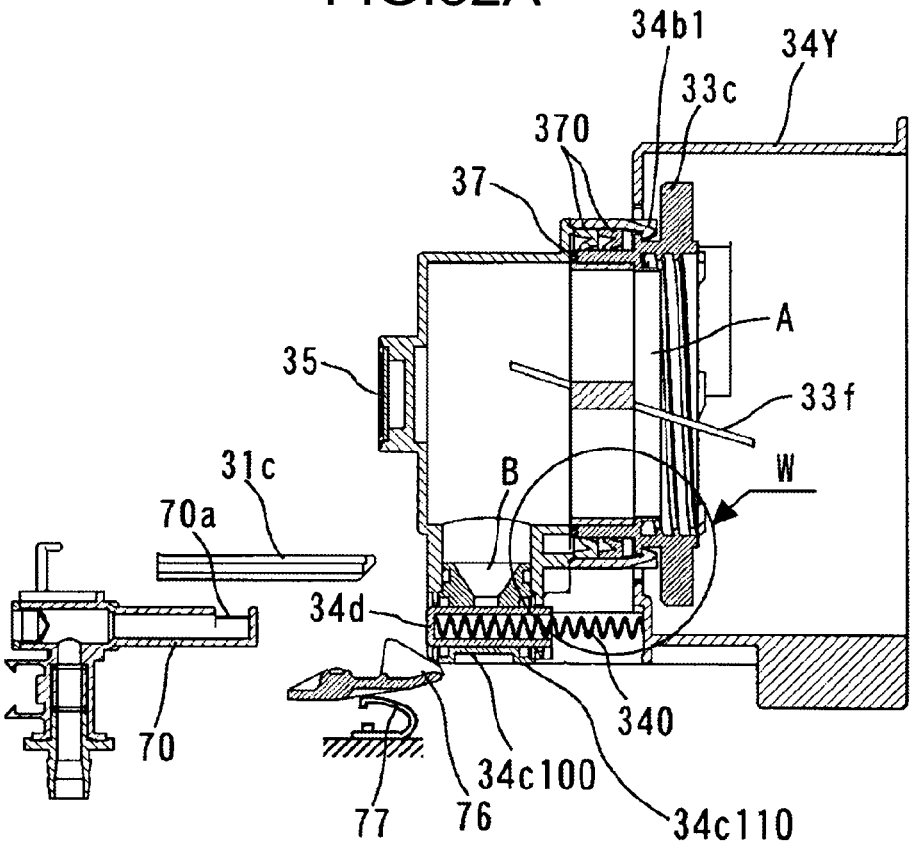
FIGS. 32A and 32B are schematic diagrams representing a state where a toner container is attached to a toner-container holding unit according to an eighth embodiment of the present invention.
Figure 32B:
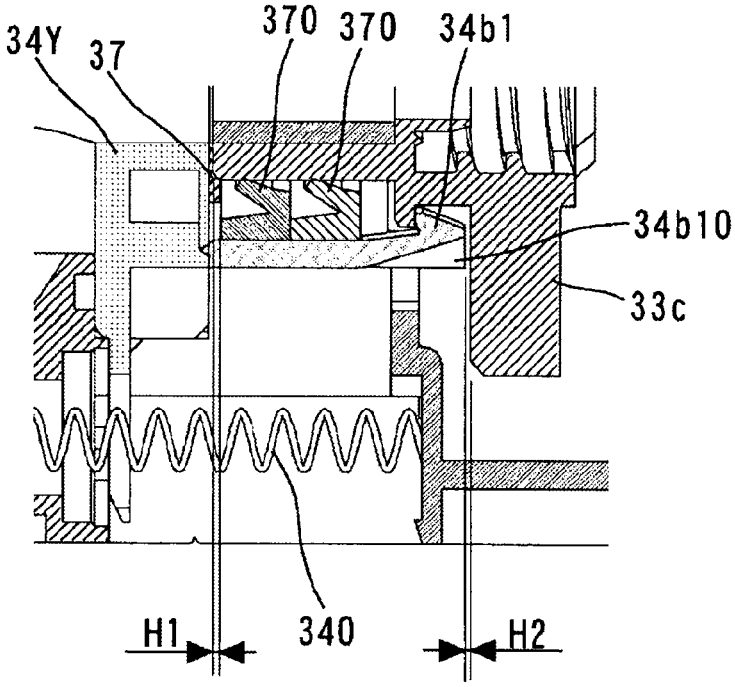

FIGS. 14, 16 to 23, 32A, and 32B depict a state where the toner container 32Y according to the eighth embodiment of the present invention is attached to a toner-container holding unit 31. FIG. 32B is an enlarged view of a portion W in FIG. 32A. The toner container 32Y has substantially the same configuration as the toner container 32Y in the fifth embodiment except that a protection cap 38 that cover an IC chip 35 is not provided.

As shown in FIGS. 14 and 32A, the toner container 32Y includes a container body 33Y and a cap portion 34Y including a plug member 34*d* (an opening/closing member), and a toner discharge opening B is formed in the cap portion 34Y in the same manner as the above embodiments. With such a configuration, there is less toner stain in the toner discharge opening B, and it is prevented that a user's hand becomes stained with toner by touching the toner discharge opening B. Therefore, the operability/workability upon replacement of the toner container 32Y is improved.

The toner container 32Y has a length of about 621 mm in the longitudinal direction and an outer diameter of 115 mm, and the diameter of an opening A formed in the toner container 32Y is 53.5 mm, in the same manner as those in the second embodiment.

As shown in FIGS. 32A and 32B, two of a packing 370, such as two G-seals are arranged in a row between the container body 33Y and the cap portion 34Y around the opening A in the same manner as the fifth embodiment.

Even if the container body 33Y is eccentrically attached to the cap portion 34Y or the container body 33Y is driven to rotate eccentrically with respect to the cap portion 34Y, lip portions (rubber portions) of the packings 370 follow the movement of the container body 33Y and wear little over time. Thus, the sealing properties between the container body 33Y and the cap portion 34Y are stably improved. Particularly, because a plurality of the packings 370 are provided, the improvement of the sealing properties is remarkable.

As shown in FIG. 6, the packings 370 are arranged so that a tip of a lip portion of each packing 370, which makes contact with the periphery of the container body 33Y, is inclined in such a manner that an inner diameter of the lip portion becomes smaller toward the opening A of the container body 33Y (right side in FIG. 6). In other words, the tip of the lip portion is inclined toward the side on which the toner is contained (the side opposite to the side on which the toner should not be scattered). Thus, the sealing properties between the container body 33Y and the cap portion 34Y by the packings 370 are improved.

The packings 370 are arranged so that tips of the lip portions are inclined in the same direction. Therefore, when the cap portion 34Y is attached to the container body 33Y, the lip portion does not roll up easily.

A tube shaped sealing member 37 made of an elastic material such as foamed polyurethane is provided in a clearance H1 (about 0.5 mm to 1 mm) between the cap portion 34Y and the container body 33Y in the same manner as that in the fourth embodiment. The original thickness of the sealing member 37 is about 1.5 mm to 2 mm. Specifically, the sealing member 37 is adhered to the end surface of the cap portion 34Y opposing a tip end surface 33*a* around the opening A of the container body 33Y.

Provision of a sealing member on the circumferential surface of the container body 33Y (the cap portion 34Y) may generate a gap between the seal member and the container body 33Y with time, which may result in scattering toner. This is because the container body 33Y is driven to rotate in a state where the rotational center of the container body 33Y is decentered downward due to the weight of the toner, i.e., in a state where the sealing performance between the sealing member and the container body 33Y is reduced.

In this embodiment, however, because the sealing member 37 is provided to the end surface of the cap portion 34Y, even when the rotational center of the container body 33Y is decentered downward due to the weight of the toner, no gap is generated between the sealing member 37 and the container body 33Y (the cap portion 34Y).

In the new toner container 32Y, a clearance H2 (0 mm<H2≦1 mm) is provided between the cap portion 34Y and the end surface of a gear portion 33*c* shown in FIG. 32B. Even if the sealing member 37 or the packing 370 wears over time, and the container body 33Y starts to rotate in an eccentric manner, the end surface of the gear portion 33*c* comes into contact with a tilt preventing portion 34*b*10 formed on a claw 34*b*1 (a snap-fit portion) of the cap portion 34Y to prevent a container body 33Y from further tilting. Therefore, the sealing member 37 or the lip portions of the packings 370 is not further compressed, so that the sealing member 37 or the lip portions of the packings 370 does not wear such a degree to cause toner scattering.

The gear portion 33*c* is not integrally formed with the container body 33Y, and is screwed into the container body 33Y as a separate member in the same manner as the fifth embodiment.

Specifically, as shown in FIG. 8, a thread groove 33*c*10 is formed on the inner circumferential surface of the gear portion 33*c*. A stirring member 33*f* is fitted into the inner circumferential surface of the gear portion 33*c*, and the thread groove 33*c*10 is screwed into a screw thread 33Y10 formed on the outer circumferential surface of the opening portion of the container body 33Y. At this time, when a projection 33*c*11 formed on the inner circumferential surface of the gear portion 33*c* slides over a projection 33Y11 formed on the container body 33Y, the position of the gear portion 33*c* with respect to the container body 33Y is determined. With the provision of the projections 33*c*11 and 33Y11, the gear portion 33*c* attached to the container body 33Y is prevented from being detached from the container body 33Y.

Preferably, the direction in which the thread groove 33*c*10 is screwed into the screw thread 33Y10 matches the rotational direction of the container body 33Y. Thus, the rotational force is surely transmitted from the gear portion 33*c* to the container body 33Y, and it is prevented that when the container body 33Y is driven to rotate, the meshing of the screw thread 33Y10 and the thread groove 33*c*10 is loosened, and the gear portion 33*c* is detached from the container body 33Y.

Because the gear portion 33*c* and the container body 33Y are separate members, the following requirements can be satisfied. That is, for example, to manufacture the gear portion 33*c* with higher precision than that of the container body 33Y, to recycle the container body 33Y by replacing only the gear portion 33*c*, which often wears out mechanically, and to manufacture the gear portion 33*c*, which often wears out mechanically, with a material having a mechanical strength higher than that of the container body 33Y.

As shown in FIGS. 14 and 32A, the toner-container holding unit 31 (a holding portion 73) includes a nozzle 70, a claw member 76, a plate spring 77 as a second biasing member, and positioning members 31*c* in the same manner as that in the above embodiments.

A groove 34*c*100 and an erection portion 34*c*110 are provided on the bottom side of the cap portion 34Y. The groove 34*c*100 is positioned to correspond to projections (claws) of the claw member 76, and is formed not to interfere with the movement of the claw member 76 upon the attachment/detachment operation of the toner container 32Y (or support the claw member 76 with an extremely small force). The claw member 76 moves along the groove 34*c*100 along with the attachment operation of the toner container 32Y, and comes into contact with the erection portion 34*c*110.

In synchronization with the attachment operation of the toner container 32Y, the claw member 76 relatively moves along the bottom (the groove 34*c*100) of the cap portion 34Y. Then, the claw member 76 is pushed by the erection portion 34*c*110 to retract to the position where the attachment of the cap portion 34Y is not obstructed, and moves to the position at which the claw member 76 is engaged with the plug member 34*d*. In synchronization with the detachment operation of the toner container 32Y, after biasing the plug member 34*d*, the claw member 76 is pushed by the erection portion 34*c*110 to retract to the position where the detachment of the cap portion 34Y is not obstructed. Then, the claw member 76 relatively moves along the bottom (the groove 34*c*100) of the cap portion 34Y.

Upon the attachment operation of the toner container 32Y to the toner-container holding unit 31, after the engagement of the cap portion 34Y and the positioning members 31*c* is started, the claw member 76 is pushed by the erection portion 34*c*110 to retract to the position where the attachment of the cap portion 34Y is not obstructed.

When the toner container 32Y is attached to the toner-container holding unit 31, a container cover 31A (or a door 110) is first opened to expose the toner-container holding unit 31 to the front side.

Then, as shown in FIGS. 14 and 32A, the toner container 32Y is pushed into the toner-container holding unit 31 from the cap portion 34Y side along the longitudinal direction of the container body 33Y (the toner container 32Y).

Thereafter, when the cap portion 34Y reaches the holding portion 73, positioning of the cap portion 34Y is started by sliding a first sliding portion 34*c*1 of the cap portion 34Y along a sliding surface 31*a* of the toner-container holding unit 31 and sliding a second sliding portion 34*c*2 of the cap portion 34Y along a sliding surface (side surface) of the toner-container holding unit 31. Specifically, as shown in FIGS. 16 and 17, engaging portions 34*g* of the cap portion 34Y and the positioning members 31*c* of the toner-container holding unit 31 start to be engaged with each other. During this time, the claw member 76 relatively moves along the bottom (the groove 34*c*100) without interfering with the movement of the cap portion 34Y (without changing the posture of the cap portion 34Y).

Thus, the engagement of the engaging portions 34*g* and the positioning members 31*c* is surely started without the cap portion 34Y being biased by the claw member 76. In other words, it is possible to prevent that the engaging portions 34*g* are pushed up by the biasing force by the claw member 76, and the engaging portions 34*g* and the positioning members 31*c* are not engaged with each other.

Thereafter, when the attachment operation of the toner container 32Y is further progressed, as shown in FIGS. 18 and 19, the claw member 76 is pushed by the erection portion 34*c*110 and retracts to the position where the attachment of the cap portion 34Y is not obstructed while the engaging portions 34*g* are engaged with the positioning members 31*c*. That is, the claw member 76 rotates clockwise in FIG. 19 centering around the rotational axis. Specifically, the claw member 76 is pushed by the erection portion 34*c*110 to be pushed down in the direction that resists the biasing force of the plate spring 77.

Thereafter, when the attachment operation of the toner container 32Y is further progressed, as shown in FIGS. 20 and 21, the claw member 76 moves to the position where the claw member 76 is engaged with the plug member 34*d* while the engaging portions 34*g* are engaged with the positioning members 31*c*. That is, the claw member 76 rotates counterclockwise in FIG. 21 centering around the rotational axis. Specifically, the claw member 76 is released from the pushing force of the erection portion 34*c*110 and is pushed up to its default position by the biasing force of the plate spring 77.

In FIGS. 20 and 21, the plug member 34*d* is held by the nozzle 70 and the claw member 76, and the position of the plug member 34*d* is fixed in the toner-container holding unit 31.

When the toner container 32Y is further moved in the attachment direction (left side in FIG. 21) from the state shown in FIGS. 20 and 21, the toner discharge opening B is opened while the position of the plug member 34*d* is fixed. That is, the plug member 34*d* relatively moves. Specifically, while the engaging portions 34*g* are engaged with the positioning members 31*c*, the plug member 34*d* is pushed by the nozzle 70 in a direction that resists the biasing force by a compression spring 340 with the insertion of the front end of the nozzle 70 into the hole of a holder 34*c*.

As shown in FIGS. 22 and 23, the position of the cap portion 34Y is fixed at the position (contact reference position) where the holder 34*c* comes into contact with the holding portion 73, and at the same time, the plug member 34*d* fully opens the toner discharge opening B and the gear portion 33*c* meshes with a drive gear 31*g* of a drive unit of the toner-container holding unit 31. Therefore, the toner discharge opening B communicates with the toner supply opening 70*a* in the nozzle 70, and the attachment operation of the toner container 32Y is completed.

When the toner container 32Y is taken out (detached) from the toner-container holding unit 31, the operation is performed in the reverse manner of the attachment operation.

First, in synchronization with the separation operation (detachment operation) of the toner container 32Y from the toner-container holding unit 31, the plug member 34*d* is biased by the claw member 76 and the compression spring 340 while the position of the plug member 34*d* is fixed in the holding portion 73 by the nozzle 70 and the claw member 76, to close the toner discharge opening B. At this time, the end surface (a right end surface in FIG. 21) of the plug member 34*d* is fitted into the fitting portion formed on the cap portion 34Y, and the toner discharge opening B is closed. Thereafter, when the toner container 32Y further moves in the separating direction, the claw member 76 moves to the position where the separation of the cap portion 34Y is not obstructed (see, FIGS. 18 and 19). Then, the claw member 76 is released from the pushing force of the erection portion 34*c*110, to return to the default position by the biasing force of the plate spring 77.

The attachment/detachment operation of the toner container 32Y in the eighth embodiment can of course be employed in the above embodiments.

According to the eighth embodiment, the toner container 32Y includes the container body 33Y and the cap portion 34Y, and the cap portion 34Y is provided with the toner discharge opening B and the plug member 34*d*, in the same manner as the above embodiments. Thus, there is less toner stain in the toner discharge opening B, and it is prevented that a user's hand becomes stained with toner by touching the toner discharge opening B. Therefore, the operability/workability upon replacement of the toner container 32Y is improved.

Furthermore, according to the eighth embodiment, the packings 370 are arranged in series between the container body 33Y and the cap portion 34Y around the opening A in the same manner as the fifth embodiment. Thus, even if the container body 33Y is eccentrically attached to the cap portion 34Y or the container body 33Y is driven to rotate eccentrically with respect to the cap portion 34Y, the sealing properties between the container body 33Y and the cap portion 34Y are improved.

The present invention is not limited to the above embodiments, and it will be apparent that the above embodiments can be appropriately changed other than those indicated in the embodiments, without departing from the technical spirit of the present invention. Furthermore, the number, the position, and the shape of the components are not limited to those shown in the embodiments, and any preferable number, position, and shape in implementing the present invention can be used.

According to the above embodiments, the toner container attached to the toner-container holding unit is optimized in structure, and the protection member that covers the electronic component is provided. Therefore, it is possible to provide a toner container, a process cartridge, and an image forming apparatus, in which the operability/workability upon replacement is improved, the occurrence of toner stain is reduced, and the electronic component is not damaged.

Accordingly, a toner container, a process cartridge, and an image forming apparatus according to the above embodiments have the following technical characteristics.

A toner container according to one aspect of the present invention is configured to be attached to a toner-container holding unit of an image forming apparatus in a detachable manner. The toner container includes a container body that contains toner therein; and a cap portion that is held by the toner-container holding unit and that includes a toner discharge opening to discharge the toner contained in the container body. A gear portion that transmits a rotational force to the container body is attached to the container body in a detachable manner.

According to the present invention, the gear portion includes a first screw portion that is screwed into a second screw portion formed on the container body.

According to the present invention, the first screw portion is formed such that a direction in which the gear portion is screwed into the container body matches a direction to which the container body is driven to rotate.

According to the present invention, the second screw portion has at least two threads.

According to the present invention, the container body and the gear portion are made of different materials.

According to the present invention, the cap portion includes an opening/closing member that opens and closes the toner discharge opening in synchronization with an attachment operation and a detachment operation to and from the toner container holding unit.

According to the present invention, the toner-container holding unit includes a nozzle communicating with the toner discharge opening, and the opening/closing member is a plug member that is pushed by the nozzle to open the toner discharge opening in synchronization with the attachment operation to the toner-container holding unit, and is biased by the biasing member to close the toner discharge opening in synchronization with the detachment operation to the toner-container holding unit.

According to the present invention, the cap portion discharges the toner discharged from an opening of the container body from the toner discharge opening, and is held to be nonrotatable with respect to the toner-container holding unit.

According to the present invention, a length in a longitudinal direction is equal to or longer than 500 millimeters.

According to the present invention, a toner is contained in the toner container.

According to the present invention, a carrier is further contained in the toner container.

An image forming apparatus according to another aspect of the present invention includes a toner-container holding unit; and a toner container configured to be attached to the toner-container holding unit in a detachable manner. The toner container includes a container body that contains toner therein, and a cap portion that is held by the toner-container holding unit and that includes a toner discharge opening to discharge the toner contained in the container body. A gear portion that transmits a rotational force to the container body is attached to the container body in a detachable manner.

A toner container according to still another aspect of the present invention is configured to be attached to a toner-container holding unit of an image forming apparatus in a detachable manner. The toner container includes a container body that contains toner therein; and a cap portion that is held by the toner-container holding unit and that includes a toner discharge opening to discharge the toner contained in the container body. A plurality of packings are provided between the container body and the cap portion around the opening of the container body.

According to the present invention, at least one of the packings is arranged so that a tip of a lip portion is inclined in such a manner that an inner diameter of the lip portion becomes smaller toward the opening of the container body.

According to the present invention, the packings are arranged such that tips of lip portions are inclined in a same direction.

According to the present invention, the cap portion discharges the toner discharged from the opening of the container body from the toner discharge opening, and is held to be nonrotatable with respect to the toner-container holding unit.

According to the present invention, a length in a longitudinal direction is equal to or longer than 500 millimeters.

According to the present invention, a toner is contained in the toner container.

According to the present invention, a carrier further is contained in the toner container.

An image forming apparatus according to still another aspect of the present invention includes a toner-container holding unit; and a toner container configured to be attached to the toner-container holding unit in a detachable manner. The toner container includes a container body that contains toner therein, and a cap portion that is held by the toner-container holding unit and that includes a toner discharge opening to discharge the toner contained in the container body. A plurality of packings are provided between the container body and the cap portion around the opening of the container body.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner container configured to be attached to a toner-container holding unit of an image forming apparatus in a detachable manner, the toner container comprising:

a container body that contains toner therein; and a cap portion that is held by the toner-container holding unit and that includes a toner discharge opening to discharge the toner contained in the container body, wherein a gear portion that transmits a rotational force to the container body is attached to the container body in a detachable manner, wherein the gear portion includes a first screw portion that is screwed into a second screw portion formed on the container body.

2. The toner container according to claim 1, wherein the first screw portion is formed such that a direction in which the gear portion is screwed into the container body matches a direction to which the container body is driven to rotate.

3. The toner container according to claim 2, wherein the second screw portion has at least two threads.

4. The toner container according to claim 3, wherein the container body and the gear portion are made of different materials.

5. The toner container according to claim 4, wherein the cap portion includes an opening/closing member that opens and closes the toner discharge opening in synchronization with an attachment operation and a detachment operation to and from the toner container holding unit.

6. The toner container according to claim 5, wherein the toner-container holding unit includes a nozzle communicating with the toner discharge opening, and the opening/closing member is a plug member that is pushed by the nozzle to open the toner discharge opening in synchronization with the attachment operation to the toner-container holding unit, and is biased by the biasing member to close the toner discharge opening in synchronization with the detachment operation to the toner-container holding unit.

7. The toner container according to claim 6, wherein the cap portion discharges the toner discharged from an opening of the container body from the toner discharge opening, and is held to be nonrotatable with respect to the toner-container holding unit.

8. The toner container according to claim 7, wherein a length in a longitudinal direction is equal to or longer than 500 millimeters.

9. The toner container according to claim 8, wherein a toner is contained therein.

10. The toner container according to claim 9, wherein a carrier is further contained therein.

11. An image forming apparatus comprising:

a toner-container holding unit; and a toner container configured to be attached to the toner-container holding unit in a detachable manner, wherein the toner container includes a container body that contains toner therein, and a cap portion that is held by the toner-container holding unit and that includes a toner discharge opening to discharge the toner contained in the container body, and a gear portion that transmits a rotational force to the container body is attached to the container body in a detachable manner, wherein the gear portion includes a first screw portion that is screwed into a second screw portion formed on the container body.

12. The toner container according to claim 1, wherein toner is contained therein.

13. The toner container according to claim 12, wherein carrier is further contained therein.

14. The toner container according to claim 1, wherein the container body comprises:

a projection to engage with the gear portion to prevent the gear portion from being detached.

15. The toner container according to claim 14, wherein the gear portion includes:

a projection to engage with the projection of the container body.

16. The image forming apparatus according to claim 11, wherein toner is contained within the toner container.

17. The image forming apparatus according to claim 16, wherein carrier is contained within the toner container.

18. The image forming apparatus according to claim 11, wherein the container body comprises:

a projection to engage with the gear portion to prevent the gear portion from being detached.

19. The image forming apparatus according to claim 18, wherein the gear portion includes:

a projection to engage with the projection of the container body.

* * * * *